US012560404B2

(12) United States Patent
Pulkrabek et al.

(10) Patent No.: US 12,560,404 B2
(45) **Date of Patent: *Feb. 24, 2026**

(54) CROSSBOW

(71) Applicant: Ravin Crossbows, LLC, Superior, WI (US)

(72) Inventors: Larry Pulkrabek, Osceola, IA (US); Jay Engstrom, Port Wing, WI (US); Craig Thomas Yehle, Winona, MN (US); Aaron Pellett, Alborn, MN (US); Matthew P. Haas, Duluth, MN (US); Fred H. Hunt, Athol, ID (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/286,694

(22) Filed: Feb. 27, 2019

(65) Prior Publication Data

US 2019/0186865 A1 Jun. 20, 2019

Related U.S. Application Data

(63) Continuation of application No. 15/171,391, filed on Jun. 2, 2016, now Pat. No. 10,260,835, which is a (Continued)

(51) Int. Cl.

| | |
|---|---|
| ***F41B 5/14*** | (2006.01) |
| ***F41A 19/06*** | (2006.01) |
| ***F41B 5/12*** | (2006.01) |

(52) U.S. Cl.

CPC ..... *F41B 5/1469* (2013.01); *F41B 5/123* (2013.01); *F41A 19/06* (2013.01)

(58) Field of Classification Search

CPC ..... F41B 5/123; F41B 5/1469; F41B 5/12; F41A 19/06

See application file for complete search history.

(56) References Cited

U.S. PATENT DOCUMENTS

| | | | |
|---|---|---|---|
| 213,976 | A | 4/1879 | Coloney |
| 214,791 | A | 4/1879 | Randall |

(Continued)

FOREIGN PATENT DOCUMENTS

| | | | | |
|---|---|---|---|---|
| CA | 2640377 | A1 * | 1/2008 | ..... A01K 81/00 |
| WO | WO2011/141771 | A1 | 11/2011 | |
| WO | WO2011/158062 | A1 | 12/2011 | |

OTHER PUBLICATIONS

U.S. Appl. No. 13/799,518, filed Mar. 13, 2013, Energy Storage Device for a Box, U.S. Pat. No. 9,255,753, Feb. 9, 2016.

(Continued)

*Primary Examiner* — Eugene L Kim
*Assistant Examiner* — Amir A Klayman
(74) *Attorney, Agent, or Firm* — Foley & Lardner LLP

(57) ABSTRACT

The present disclosure is directed to a crossbow having first and second limbs with distal portions pivotally coupled to the frame at distal limb mounts and proximal portions pivotally coupled to the frame at proximal limb mounts. First and second cams are attached to the first and second limbs at locations between the distal portion and the proximal portions. A cocking mechanism slides on the center rail to engage with a draw string in the released configuration and slides to a retracted position to move the draw string to the drawn configuration and to engage with a trigger assembly.

7 Claims, 35 Drawing Sheets

Related U.S. Application Data continuation of application No. 14/071,723, filed on Nov. 5, 2013, now Pat. No. 9,383,159, which is a continuation-in-part of application No. 13/799,518, filed on Mar. 13, 2013, now Pat. No. 9,255,753.

(60) Provisional application No. 61/820,792, filed on May 8, 2013.

(56) References Cited

U.S. PATENT DOCUMENTS 369,153 A 8/1887 Alley
437,605 A 9/1890 Kelley
477,747 A * 6/1892 Emerson ..... A63B 65/08 124/16
785,050 A * 3/1905 Baunders ..... F41B 5/12 124/25
1,985,079 A 12/1934 Corklin
2,092,361 A 9/1937 Shirn
2,278,535 A 4/1942 Dobson
2,375,607 A 5/1945 Wulfert
2,520,713 A 8/1950 Diehr
2,542,777 A 2/1951 Loew
2,818,849 A 1/1958 McKay
2,918,050 A 12/1959 Kopman
3,028,851 A * 4/1962 Drake ..... F41B 5/12 124/16
3,043,287 A 7/1962 Nelson
3,427,016 A 2/1969 Harris
3,515,113 A * 6/1970 Lawrence ..... F41B 5/12 124/27
3,625,193 A * 12/1971 Palma ..... F41B 5/0073 124/23.1
3,670,711 A * 6/1972 Firestone ..... F41B 5/12 124/35.1
3,744,473 A * 7/1973 Nishioka ..... F41B 5/0094 124/25.6
3,802,410 A * 4/1974 Palma ..... F41B 5/0073 124/88
3,987,777 A * 10/1976 Darlington ..... F41B 5/105 124/86
4,030,473 A 6/1977 Puryear
4,050,438 A * 9/1977 Pfotenhauer ..... F41B 3/02 124/20.1
4,054,118 A 10/1977 McKee et al.
4,064,862 A 12/1977 Groner
4,072,254 A 2/1978 Cox
4,078,538 A 3/1978 Shepley
4,079,723 A 3/1978 Darlington
4,169,456 A * 10/1979 Van House ..... F41B 5/12 124/25
4,187,826 A 2/1980 Killian
4,192,281 A 3/1980 King
4,241,715 A 12/1980 Jennings
4,246,883 A * 1/1981 Ash ..... F41B 5/1469 124/86
4,261,320 A 4/1981 Barna
4,287,867 A 9/1981 Islas
4,305,588 A 12/1981 Dodge
4,338,910 A 7/1982 Darlington
4,340,025 A 7/1982 Caldwell
4,340,930 A 7/1982 Carissimi
4,388,914 A 6/1983 Cesin
4,457,288 A * 7/1984 Ricord ..... F41B 5/10 124/900
4,479,480 A 10/1984 Holt
4,515,142 A 5/1985 Nurney
4,541,401 A 9/1985 Caldwell
4,544,163 A 10/1985 Scanlon
4,545,358 A 10/1985 Collins
4,547,837 A 10/1985 Bennett
4,565,182 A 1/1986 Barnett
4,587,944 A 5/1986 Barnett
4,593,675 A 6/1986 Waiser
4,603,676 A 8/1986 Luoma
4,645,211 A 2/1987 Beiter
4,649,890 A 3/1987 Powers
4,649,891 A 3/1987 Bozek
4,662,345 A * 5/1987 Stephens ..... F41B 5/12 124/40
4,688,539 A * 8/1987 Lawrence ..... F41B 5/12 124/84
4,693,228 A 9/1987 Simonds et al.
4,697,571 A 10/1987 Waiser
4,703,744 A * 11/1987 Taylor ..... F41B 3/02 124/20.1
4,719,897 A 1/1988 Gaudreau
4,722,318 A 2/1988 Yankey
4,756,296 A 7/1988 Darlington
4,766,874 A 8/1988 Nishioka
4,796,598 A 1/1989 Jones
D301,272 S 5/1989 Barrow et al.
4,827,894 A * 5/1989 Schallberger ..... F41B 5/12 124/25
4,877,008 A 10/1989 Troubridge
4,917,071 A * 4/1990 Bozek ..... F41B 5/12 124/24.1
4,926,574 A * 5/1990 Rieger ..... F41A 19/34 42/70.08
4,942,861 A 7/1990 Bozek
5,024,206 A 6/1991 Lester
5,067,731 A 11/1991 Bickel
5,085,200 A 2/1992 Horton-Corcoran et al.
5,115,795 A 5/1992 Farris
5,119,797 A 6/1992 Anderson
5,134,552 A 7/1992 Call
5,154,432 A 10/1992 Sanders
5,174,268 A 12/1992 Martin et al.
5,205,267 A * 4/1993 Burdick ..... F41B 5/10 124/44.5
5,211,155 A 5/1993 Zamojski
5,215,069 A * 6/1993 Liu ..... F41B 5/12 124/40
5,220,906 A 6/1993 Choma
D337,145 S 7/1993 Horton-Corcoran
5,224,463 A 7/1993 Townsend
5,243,956 A 9/1993 Luehring
5,256,124 A 10/1993 Hughes
5,265,584 A 11/1993 Judson et al.
5,290,044 A 3/1994 Easton et al.
5,301,651 A 4/1994 Larson
5,306,019 A 4/1994 Guest et al.
5,307,787 A 5/1994 LaBorde et al.
5,368,006 A 11/1994 McPherson
5,388,564 A 2/1995 Islas
5,417,439 A 5/1995 Bickel
5,439,231 A 8/1995 Roberts et al.
5,445,139 A 8/1995 Bybee
5,495,843 A 3/1996 Larson
5,505,185 A 4/1996 Miller
5,522,373 A 6/1996 Barnett
5,547,200 A 8/1996 Rangel
5,596,976 A 1/1997 Waiser
5,598,829 A * 2/1997 Bednar ..... F41B 5/12 124/40
5,630,405 A 5/1997 Nizov
5,638,804 A * 6/1997 Remick ..... F41B 5/10 124/900
5,649,520 A 7/1997 Bednar
5,651,354 A * 7/1997 La Haise, Sr. ..... F41B 5/0031 124/88
5,660,159 A 8/1997 Clayton
5,671,723 A 9/1997 Goff et al.
5,678,528 A 10/1997 Hadley
5,678,529 A 10/1997 Larson
5,687,703 A 11/1997 Vyprachticky
5,697,355 A 12/1997 Schaffer
5,706,794 A * 1/1998 Neal ..... F41B 5/10 124/23.1
5,749,348 A 5/1998 Oviedo-Reyes
5,765,536 A 6/1998 Scott
5,782,229 A 7/1998 Evans et al.

(56) References Cited

U.S. PATENT DOCUMENTS 5,803,843 A 9/1998 Anderson et al.
5,823,172 A 10/1998 Suggitt
5,823,902 A 10/1998 Guest et al.
5,859,119 A 1/1999 Hoefflin
5,884,614 A 3/1999 Darlington et al.
5,890,480 A 4/1999 McPherson
5,902,199 A 5/1999 Adams
5,921,227 A 7/1999 Allshouse et al.
5,934,264 A * 8/1999 Doornenbal ..... F41B 5/0005 124/23.1
5,934,265 A 8/1999 Darlington
5,960,778 A 10/1999 Larson
5,975,067 A 11/1999 Strother
5,987,724 A 11/1999 Kleman
6,017,284 A 1/2000 Giles
6,073,351 A 6/2000 Barnett
6,095,128 A 8/2000 Bednar
6,112,732 A 9/2000 Larson
6,123,631 A 9/2000 Ginder
6,155,243 A 12/2000 Gallops
6,205,990 B1 * 3/2001 Adkins ..... F41B 5/12 124/40
6,267,108 B1 7/2001 McPherson et al.
6,286,496 B1 9/2001 Bednar
6,360,735 B1 3/2002 Larson et al.
6,367,464 B1 * 4/2002 Bronnert ..... F41B 5/0068 124/23.1
6,390,642 B1 5/2002 Simonton
6,415,780 B1 7/2002 Proctor
6,425,386 B1 7/2002 Adkins
6,460,528 B1 10/2002 Gallops
6,470,870 B1 10/2002 Schaar
6,474,324 B1 11/2002 Despart et al.
6,571,785 B1 6/2003 Choma
6,651,641 B1 11/2003 Bower et al.
6,705,304 B1 3/2004 Pauluhn
6,712,057 B2 3/2004 Andrews
6,736,123 B1 * 5/2004 Summers ..... F41B 5/1469 124/40
6,736,742 B2 5/2004 Price et al.
6,763,819 B2 7/2004 Eckert
6,776,148 B1 8/2004 Islas
6,786,214 B2 9/2004 Andrews
6,792,930 B1 9/2004 Kronengold et al.
6,792,931 B1 9/2004 Schaar
6,799,566 B1 * 10/2004 Malucelli ..... F41B 5/12 124/25
6,802,304 B1 * 10/2004 Chang ..... F41B 5/123 124/40
6,874,491 B2 4/2005 Bednar
6,874,492 B1 4/2005 Schavone
6,901,921 B1 6/2005 Barnett
6,913,007 B2 * 7/2005 Bednar ..... F41B 5/123 124/25
6,990,970 B1 1/2006 Darlington
7,017,568 B1 3/2006 Smith
7,021,784 B2 4/2006 DiCarlo
7,047,958 B1 5/2006 Colley
7,066,166 B2 * 6/2006 Crites, Jr. ..... F41B 5/1469 124/25
7,100,590 B2 * 9/2006 Chang ..... F41B 5/123 124/25
7,174,884 B2 2/2007 Kempf et al.
7,189,170 B1 3/2007 Korsa et al.
7,204,242 B2 4/2007 Dziekan
7,211,011 B1 5/2007 Sutherland
7,305,979 B1 12/2007 Yehle
7,328,693 B2 2/2008 Kempf
7,363,921 B2 4/2008 Kempf
7,441,555 B1 10/2008 Larson
D589,578 S 3/2009 Choma
7,506,643 B2 3/2009 Holmberg
D590,907 S 4/2009 Barnett
D595,803 S 7/2009 Giles
7,578,289 B2 8/2009 Norkus
7,588,022 B2 9/2009 Chang
7,624,724 B2 12/2009 Bednar et al.
7,624,725 B1 * 12/2009 Choma ..... F41B 5/123 124/25
7,637,256 B2 12/2009 Lee
7,677,233 B2 3/2010 Bednar
7,699,045 B1 4/2010 Kronengold et al.
7,708,001 B2 5/2010 Kempf
7,721,721 B1 5/2010 Kronengold et al.
7,743,760 B2 6/2010 Woodland
7,748,370 B1 7/2010 Choma
7,753,041 B2 7/2010 Ogawa
7,767,738 B2 8/2010 Gagger et al.
7,770,567 B1 * 8/2010 Yehle ..... F41A 17/46 124/40
7,770,568 B1 8/2010 Yehle
7,784,452 B1 8/2010 Kronengold et al.
7,784,453 B1 * 8/2010 Yehle ..... F41B 5/1469 124/25
7,810,480 B2 10/2010 Shepley et al.
7,814,894 B2 * 10/2010 Giroux ..... F41B 5/1469 124/40
7,823,572 B2 * 11/2010 Anderson ..... F41B 5/1469 124/25
7,827,240 B1 11/2010 Atkins et al.
7,832,386 B2 11/2010 Bednar et al.
7,832,387 B1 11/2010 Yehle
7,832,388 B1 11/2010 Kronengold et al.
7,836,871 B2 11/2010 Kempf
7,837,580 B2 11/2010 Huang et al.
7,862,457 B1 1/2011 Urcheck
7,891,348 B2 * 2/2011 Colley ..... F41B 5/123 124/25
7,891,349 B1 2/2011 Kronengold et al.
7,918,218 B1 4/2011 Kronengold et al.
7,922,609 B1 4/2011 Hajari
7,931,550 B2 4/2011 Lynch
7,938,108 B2 5/2011 Popov
D641,827 S 7/2011 Errett
7,971,582 B1 7/2011 Larson
7,980,236 B1 7/2011 Kronengold et al.
7,993,224 B2 8/2011 Brywig
7,997,258 B2 8/2011 Shepley et al.
8,016,703 B1 9/2011 Kronengold et al.
8,020,543 B2 9/2011 Maleski et al.
8,033,275 B2 10/2011 Bednar et al.
8,037,876 B1 10/2011 Yehle
8,042,530 B2 10/2011 Barnett
8,082,910 B1 12/2011 Yehle
8,091,540 B2 1/2012 Matasic et al.
8,104,460 B2 * 1/2012 Ribi ..... F41B 5/10 124/25
8,104,461 B2 1/2012 Kempf
8,136,514 B2 3/2012 Howard
8,181,638 B1 5/2012 Yehle
8,191,541 B2 6/2012 Shaffer et al.
D664,625 S 7/2012 Minica
8,240,299 B2 8/2012 Kronengold et al.
8,267,816 B1 9/2012 Hajari
8,297,267 B2 10/2012 Popov
8,337,342 B1 12/2012 Huang
8,342,990 B1 1/2013 Price
8,366,573 B2 2/2013 Hunt
8,375,928 B1 2/2013 Bednar
8,387,603 B2 3/2013 Darlington
8,434,463 B2 5/2013 Bednar et al.
8,439,025 B2 5/2013 Shaffer et al.
8,439,026 B1 * 5/2013 Kilian ..... F41B 5/1469 124/35.2
8,443,790 B2 5/2013 Pestrue
8,453,631 B1 6/2013 Kronengold et al.
8,459,244 B2 6/2013 Yehle
8,469,012 B2 6/2013 Bednar et al.
8,469,013 B1 6/2013 Obteshka et al.
8,479,719 B2 7/2013 Bednar et al.
8,522,761 B1 9/2013 Chu
8,522,762 B2 9/2013 Trpkovski

(56) References Cited

U.S. PATENT DOCUMENTS 8,540,594 B2 9/2013 Chu
8,573,192 B2 * 11/2013 Bednar ..... F41B 5/1469 124/25
8,578,918 B1 11/2013 Islas
8,622,855 B2 1/2014 Bednar et al.
8,627,811 B1 1/2014 Darlington
8,635,994 B1 1/2014 Yehle
8,651,095 B2 2/2014 Islas
8,662,061 B1 3/2014 Darlington
8,671,923 B2 3/2014 Goff et al.
8,689,771 B2 4/2014 Ritz
8,701,642 B2 4/2014 Biafore
8,739,769 B1 6/2014 Obteshka et al.
8,752,535 B2 * 6/2014 Barber ..... F41B 5/1469 124/25
8,758,177 B2 6/2014 Minica
8,763,595 B1 7/2014 Bednar et al.
8,777,786 B1 7/2014 Bay
8,794,225 B2 8/2014 Bednar et al.
8,826,894 B1 9/2014 Darlington
8,833,349 B2 9/2014 Park
8,845,464 B1 9/2014 Hyde
8,851,056 B2 * 10/2014 Trpkovski ..... F41B 5/123 124/25
8,857,420 B2 10/2014 Grace
8,863,732 B1 * 10/2014 Prior ..... F41B 5/123 124/25
D717,389 S 11/2014 Huang
8,899,217 B2 12/2014 Islas
8,899,218 B2 12/2014 Kempf
8,919,332 B2 12/2014 Trpkovski
8,931,465 B1 1/2015 Choma
8,950,385 B1 2/2015 Khoshnood
8,951,152 B1 2/2015 Huang
8,978,634 B2 3/2015 Darlington
8,985,091 B2 3/2015 Miao
8,994,944 B2 3/2015 Cramer et al.
8,997,728 B2 4/2015 Popov
9,004,053 B1 4/2015 Anderson
9,010,308 B1 4/2015 Hyde
9,022,013 B2 5/2015 Trpkovski
9,097,485 B2 8/2015 Lipowski
9,140,513 B2 9/2015 Trpkovski
9,140,516 B1 9/2015 Hyde
9,140,527 B2 9/2015 Pederesen et al.
9,151,580 B2 10/2015 Pedersen
9,212,862 B2 12/2015 Biafore et al.
9,212,874 B1 12/2015 Harding
9,234,719 B1 1/2016 Kempf
9,243,861 B1 1/2016 Kempf
9,243,875 B2 1/2016 Minica
9,255,753 B2 2/2016 Pulkrabek et al.
9,255,754 B1 2/2016 Barnett
9,255,755 B1 2/2016 Kempf
9,255,756 B1 2/2016 Wu et al.
9,273,921 B2 * 3/2016 Koch ..... F41B 5/10
9,279,647 B2 3/2016 Marshall
9,279,648 B2 3/2016 Marshall
9,279,649 B2 3/2016 Bay
9,285,195 B1 3/2016 Palomaki
9,297,604 B1 3/2016 Sidebottom et al.
9,303,944 B2 * 4/2016 Barber ..... F41B 5/1449
9,335,115 B2 5/2016 Bednar et al.
9,341,430 B2 5/2016 McPherson
9,341,432 B1 * 5/2016 Wohleb ..... F16H 25/20
9,341,434 B2 * 5/2016 McPherson ..... F41B 5/123
9,347,731 B1 5/2016 Chang
9,354,015 B2 5/2016 Yehle
9,354,016 B2 5/2016 Trpkovski
9,354,018 B2 5/2016 Khoshnood
9,360,268 B2 6/2016 Khoshnood
9,377,267 B1 6/2016 Kempf
9,383,159 B2 7/2016 Pulkrabek et al.
9,389,041 B2 7/2016 Novikov
9,404,701 B2 8/2016 Lipowski
9,404,705 B2 8/2016 Kennedy
9,404,706 B2 8/2016 Khoshnood
9,404,720 B2 8/2016 Pedersen
9,417,029 B1 8/2016 Chang
9,423,202 B1 8/2016 Obteshka et al.
9,423,203 B2 * 8/2016 Simonds ..... F41B 5/123
9,423,219 B2 8/2016 Pedersen
9,434,334 B2 9/2016 Marur
9,435,605 B2 9/2016 McPherson et al.
9,441,925 B1 9/2016 Palomaki et al.
9,453,699 B1 9/2016 Barnett
9,464,861 B1 10/2016 Hughes et al.
9,470,486 B2 10/2016 Bednar et al.
9,476,665 B2 10/2016 McPherson
RE46,213 E 11/2016 Harjai
9,494,379 B2 11/2016 Yehle
9,494,380 B1 11/2016 Yehle
9,494,381 B1 * 11/2016 Jeske ..... F41B 5/12
9,500,433 B2 11/2016 McPherson
9,506,715 B2 11/2016 Hughes
9,518,806 B2 12/2016 Pedersen
9,523,549 B1 12/2016 Hughes
9,528,789 B2 12/2016 Biafore
9,546,851 B2 1/2017 Kim
9,551,544 B1 * 1/2017 Kempf ..... F41B 5/12
9,557,134 B1 1/2017 Yehle
9,568,290 B2 2/2017 Marshall
9,658,025 B2 5/2017 Trpkovski
9,689,638 B1 6/2017 Yehle
9,696,108 B2 * 7/2017 Simonds ..... F41B 5/1469
9,714,808 B2 * 7/2017 Carroll, Jr. ..... F41B 5/1469
9,719,749 B1 8/2017 Prior
9,733,051 B2 8/2017 Bay
9,746,275 B1 8/2017 Popov
9,746,277 B2 8/2017 Khoshnood
9,752,842 B1 * 9/2017 Huang ..... F41B 5/1403
9,829,268 B1 11/2017 Kempf
9,879,936 B2 1/2018 Yehle
9,897,423 B2 2/2018 Bay
9,958,232 B1 * 5/2018 Egerdee ..... F41B 5/1403
10,048,036 B1 8/2018 Kempf
10,077,963 B1 9/2018 Popov
10,077,965 B2 9/2018 Yehle
10,082,359 B2 9/2018 Yehle
10,126,088 B2 11/2018 Yehle
10,126,092 B2 * 11/2018 Ozanne ..... F41B 5/123
10,139,205 B2 11/2018 Yehle et al.
D836,743 S 12/2018 Yehle
D839,374 S 1/2019 Yehle
10,175,023 B2 1/2019 Yehle
10,190,841 B2 * 1/2019 Laurence ..... F41B 5/123
10,267,589 B1 * 4/2019 Snook ..... F41B 5/0094
10,267,592 B2 * 4/2019 Bartels ..... F41B 5/123
10,295,299 B2 * 5/2019 Vergara ..... B66D 1/06
10,408,561 B1 * 9/2019 Liu ..... F41B 5/1469
10,627,185 B2 * 4/2020 Marriott ..... F41B 5/123
10,670,368 B1 * 6/2020 Liu ..... F41B 5/12
10,746,497 B2 * 8/2020 Shaffer ..... F41B 5/123
10,921,086 B2 * 2/2021 Thalberg ..... F41B 5/1449
10,996,018 B1 * 5/2021 Kempf ..... F41B 5/105
11,002,505 B1 * 5/2021 Shaffer ..... F41B 5/12
11,015,892 B1 * 5/2021 Jessup ..... F41A 17/20
11,181,336 B2 * 11/2021 Thalberg ..... F41B 5/123
11,402,172 B2 * 8/2022 Liu ..... F41B 5/123
11,512,924 B1 * 11/2022 Xiao ..... F41B 5/143
2005/0022799 A1 2/2005 Bednar
2006/0086346 A1 * 4/2006 Middleton ..... F41B 5/12 124/25
2007/0028907 A1 2/2007 Bednar et al.
2008/0202487 A1 * 8/2008 Maleski ..... F41B 5/12 124/35.2
2008/0251058 A1 10/2008 Colley
2009/0078243 A1 3/2009 Bednar
2009/0133272 A1 * 5/2009 Lewis ..... F41G 1/467 33/265
2009/0178657 A1 7/2009 Shaffer
2009/0194086 A1 8/2009 Kempf
2009/0223500 A1 * 9/2009 Stanziale ..... F41B 5/123 124/25

(56) References Cited

U.S. PATENT DOCUMENTS

2009/0277435 A1* 11/2009 Pestrue ..... F41B 5/12 124/1
2010/0012108 A1 1/2010 Bednar et al.
2010/0031945 A1 2/2010 Shaffer et al.
2010/0113195 A1 5/2010 Rezmer
2010/0154768 A1 6/2010 Bednar et al.
2010/0170487 A1 7/2010 Kronengold et al.
2010/0170488 A1* 7/2010 Rasor ..... F41A 19/12 124/25
2010/0186728 A1 7/2010 Bednar et al.
2010/0206284 A1 8/2010 Popov
2010/0269807 A1 10/2010 Kempf
2010/0282227 A1 11/2010 Vanek
2011/0030666 A1 2/2011 Darlington
2011/0041820 A1* 2/2011 Stanziale ..... F41B 5/105 124/25
2011/0056467 A1* 3/2011 Popov ..... F41B 5/1469 124/25.6
2011/0197869 A1* 8/2011 Matasic ..... F41B 5/1469 124/25
2011/0203561 A1 8/2011 Shaffer et al.
2011/0218063 A1 9/2011 Hunt
2011/0232619 A1 9/2011 Bednar et al.
2011/0253118 A1 10/2011 Kempf
2011/0277736 A1* 11/2011 Flint ..... F41B 5/12 124/21
2011/0308508 A1 12/2011 Islas
2012/0006311 A1 1/2012 Bednar et al.
2012/0080021 A1 4/2012 Shaffer et al.
2012/0125302 A1* 5/2012 Stanziale ..... F41B 5/123 124/25
2012/0152220 A1* 6/2012 Barber ..... F41B 5/12 124/35.1
2013/0213373 A1* 8/2013 Biafore, Jr. ..... F41B 5/1403 124/25
2013/0312724 A1* 11/2013 Hudkins ..... F41B 5/123 124/25
2014/0187362 A1 7/2014 Pedersen
2014/0305417 A1* 10/2014 Barber ..... F41B 5/123 124/25
2015/0013654 A1 1/2015 Bednar et al.
2015/0040883 A1* 2/2015 McPherson ..... F41B 5/123 124/88
2015/0075016 A1* 3/2015 Wassmer ..... F41G 1/467 33/265
2015/0192395 A1 7/2015 Beck
2015/0209821 A1 7/2015 Pfahnl
2015/0233664 A1* 8/2015 McPherson ..... F41B 5/123 124/25
2015/0285581 A1* 10/2015 Chang ..... F41B 5/105 124/25
2015/0285582 A1 10/2015 Chang
2016/0045675 A1 2/2016 Cammish
2016/0195361 A1* 7/2016 Barnett ..... F41C 27/22 42/90
2016/0273869 A1 9/2016 Khoshnood
2016/0290757 A1 10/2016 Khoshnood
2017/0122691 A1 5/2017 Yehle
2017/0131058 A1 5/2017 McPherson
2017/0160044 A1 6/2017 Khoshnood
2017/0268846 A1* 9/2017 Dziekan ..... F41B 5/10
2017/0314899 A1 11/2017 Bay
2018/0051954 A1 2/2018 Yehle
2018/0051955 A1 2/2018 Yehle
2018/0094895 A1 4/2018 Yehle
2018/0156564 A1 6/2018 Laurence
2018/0187996 A1 7/2018 Yehle
2018/0231359 A1 8/2018 Yehle et al.
2018/0238655 A1 8/2018 Hout
2018/0321010 A1 11/2018 Yehle
2018/0321011 A1 11/2018 Yehle
2025/0189263 A1* 6/2025 Bednar ..... F41B 5/148
2025/0257972 A1* 8/2025 Pestrue ..... F41B 5/1469

OTHER PUBLICATIONS

U.S. Appl. No. 61/820,792, filed May 8, 2013, Cockig Mechanism for a Box.
U.S. Appl. No. 14/071,723, filed Nov. 5, 2013, De-Cocking Mechanism for a Box, U.S. Pat. No. 9,383,159, Jul. 5, 2016.
U.S. Appl. No. 15/171,391, filed Jun. 2, 2016, Cocking Mechanism for a Crossbow.
U.S. Appl. No. 14/107,058, filed Dec. 16, 2013, String Guide System for a Bow, U.S. Pat. No. 9,354,015, May 31, 2016.
U.S. Appl. No. 62/244,932, filed Oct. 22, 2015, String Guide for a Bow.
U.S. Appl. No. 15/098,537, filed Apr. 14, 2016, Crossbow, U.S. Pat. No. 9,494,379, Nov. 15, 2016.
U.S. Appl. No. 15/098,557, filed Apr. 14, 2016, String Control System for a Crossbow, U.S. Pat. No. 9,494,380, Nov. 15, 2016.
U.S. Appl. No. 15/098,568, filed Apr. 14, 2016, Reduced Friction Trigger for a Crossbow, U.S. Pat. No. 9,557,134, Jan. 31, 2017.
U.S. Appl. No. 15/098,577, filed Apr. 14, 2016, Anti-Dry Fire System for a Crossbow, U.S. Pat. No. 9,689,638, Jun. 27, 2017.
U.S. Appl. No. 15/294,993, filed Oct. 17, 2016, String Guide for a Bow, U.S. Pat. No. 9,879,936, Jan. 30, 2018.
U.S. Appl. No. 15/395,705, filed Dec. 30, 2016, Torque Control System for Cocking a Crossbow, U.S. Pat. No. 10,082,359, Sep. 25, 2018.
U.S. Appl. No. 15,395,794, filed Dec. 30, 2016, Cocking System for a Crossbow, U.S. Pat. No. 10,077,965, Sep. 18, 2018.
U.S. Appl. No. 15,395,835, filed Dec. 30, 2016, Crossbow, 2017/0122691.
U.S. Appl. No. 15/433,769, filed Feb. 15, 2017, Crossbow, U.S. Pat. No. 10,126,088, Nov. 13, 2018.
U.S. Appl. No. 15/673,784, filed Aug. 10, 2017, Arrow Assembly for a Crossbow and Methods of Using Same, 2018/0051955.
U.S. Appl. No. 15/782,238, filed Oct. 12, 2017, Cocking System for a Crossbow, U.S. Pat. No. 10,175,023, Jan. 8, 2019.
U.S. Appl. No. 15/782,259, filed Oct. 12, 2017, Crossbow with Pulleys that Rotate Around Fixed Axes, 2018/0051954.
15/821,372, filed Nov. 22, 2017, Bow, 2018/0094895.
U.S. Appl. No. 15/909,872, filed Mar. 1, 2018, Reduced Length Crossbow, 2018/0187996.
U.S. Appl. No. 16/021,443, filed Jun. 28, 2018, Crossbow, 2018/0321010.
U.S. Appl. No. 16/021,475, filed Jun. 28, 2018, Silent Cocking System for a Crossbow, 2018/0321011.
U.S. Appl. No. 16/237,062, filed Dec. 31, 2018, Crossbow with Pulleys that Rotate Around Stationary Axes.
U.S. Appl. No. 16/258,982, filed Jan. 28, 2019, Crossbow.
U.S. Appl. No. 29/594,119, filed Feb. 15, 2017, Nock for an Archery Arrow, D839374.
U.S. Appl. No. 15/631,004, filed Jun. 23, 2017, High Impact Strength Nock Assembly, U.S. Pat. No. 10/139,205, Nov. 27, 2018.
U.S. Appl. No. 15/631,016, filed Jun. 23, 2017, High Impact Strength Lighted Nock Assembly, 2018/0231359.
U.S. Appl. No. 29/627,147, filed Nov. 22, 2017, Nock for an Archery Arrow, D836743, Dec. 25, 2018.
U.S. Appl. No. 16/237,034, filed Dec. 31, 2018, High Impact Strength Lighted Nock Assembly.
Bowtech 2008 Owner's Manual (12 pages).
Bowtech model Constitution photos (6 pages).
2012 Firenock Catalog (12 pages) www/firenock.com.
Carpenteri, Stephen D., Crossbow review: Mathews' Mission MXB 360, May 26, 2013, Grand View Outdoors, https://www.grandviewoutdoors.com/big-game-hunting/deer/crossbow-review-mathews-mission-mxb-360.

(56) References Cited

OTHER PUBLICATIONS

Mission MXB 360 Review—a Crossbow by Mathews, Best Crossbow Source, https://www.bestcrossbowsource.com/mission-mxb-360-review-crossbow-matthews/.
Mission The MXB-360 cam System Produces Amazing speeds, Yet Draws Smooth, https://www.amazon.com/Mission-MXB-360-produces-amazing-smooth/dp/B071G5CYPL/?tag=bestcrossbowsource-comp-20.

* cited by examiner

CROSSBOW

RELATED APPLICATIONS

The present application is a continuation of U.S. patent application Ser. No. 15/171,391 (Allowed), entitled Cocking Mechanism for a Crossbow, filed Jun. 2, 2016, which is a continuation of U.S. patent application Ser. No. 14/071,723 (U.S. Pat. No. 9,383,159), entitled De-Cocking Mechanism for a Bow, filed Nov. 5, 2013, which is continuation-in-part of U.S. patent application Ser. No. 13/799,518 (U.S. Pat. No. 9,255,753), entitled Energy Storage Device for a Bow, filed Mar. 13, 2013 and claims the benefit of U.S. Provisional Application No. 61/820,792, entitled Cocking Mechanism for a Bow, filed May 8, 2013, the entire disclosures of which are hereby incorporated by reference.

FIELD OF THE INVENTION

The present disclosure is directed to a crossbow having first and second limbs with distal portions pivotally coupled to the frame at distal limb mounts and proximal portions pivotally coupled to the frame at proximal limb mounts. First and second cams are attached to, the first and second limbs at locations between the distal portion and the proximal portions. A cocking, mechanism slides on the center rail to engage with a draw string in the released configuration and slides to a retracted position to move the draw string to the drawn configuration and to engage with a trigger assembly.

BACKGROUND OF THE INVENTION

BOWS have been used for many years as a weapon for hunting and target shooting. More advanced, bows include cams that increase the mechanical advantage associated with the draw of the bowstring. The cams are configured to yield a decrease in draw force near full draw.

In order to cock a bow in preparation for firing the same, the string must be pulled toward a trigger assembly. Sufficient force must be exerted to bend the limbs of the bow which carry the string. Once the string is engaged by the trigger assembly, the trigger safety is activated. Then an arrow may be loaded in the crossbow with its back end in contact with the string, the trigger safety may be disengaged, and the trigger pulled to release or shoot the arrow.

The force required to cock the bow in this fashion has consistently been, a problem for users. Specifically, despite the use of compound bows with cams that attach the string to the limbs, the force required to cock a typical bow often exceeds one hundred pounds. As a result, many devices have been designed to assist in the cocking of a crossbow.

The most sophisticated of these devices is an essentially automatic cocking, machine which is attached to the stock of a bow and by means of a motorized rope system. In lieu of being motorized, these cocking devices can also be operated by means of a hand crank. While these automatic or hand cranked devices operate satisfactorily, they are somewhat expensive, add additional weight, and they are bulky when attached to the stock of the bow.

Various crossbow cocking, systems are shown, for example, in U.S. Pat. No. 4,942,861 (Bozek), U.S. Pat. No. 5,243,956 (Luehring), U.S. Pat. No. 7,624,725 (Choma), and U.S. Pat. No. 8,439,024 (Barnett).

BRIEF SUMMARY OF THE INVENTION

The present disclosure is directed to a crossbow having first and second limbs with distal portions pivotally coupled to a frame at distal limb mounts and proximal portions pivotally coupled to the frame at proximal limb mounts. First and second cams are attached to the first and second limbs at locations between the distal portion and the proximal portions. First and second cams having first and second string journals and first and second power cable journals are attached to the first and second limbs at a fixed positions, and rotate around first and second axis, at locations between the distal portion and the proximal portions. A draw string is received in the first and second draw string journals, wherein the draw string unwinds from the first and second draw string journals as it translates from a released configuration to, a drawn configuration. First and second power cables are received in the first and second power cable journals. A cocking mechanism slides on the center rail to engage with the draw string in the released configuration and slides to a retracted position to move the draw string to the drawn configuration and to engage with a trigger assembly.

In one embodiment, the cocking mechanism is coupled to a threaded shaft extending along the center rail, wherein rotation of the threaded shaft causes the cocking mechanism to move forward, and back along the center rail. The cocking mechanism preferably includes one or more of a rotary crank, a lever, or a motor that rotates the threaded shaft.

In another embodiment, the cocking mechanism is coupled to a belt extending along the center rail between a distal pulley assembly and proximal pulley assembly, wherein rotation of the belt around the distal and proximal pulley assemblies causes the cocking mechanism to move forward and back along the center rail. The belt can be one of a tooth belt, a smooth belt, or a chain. Again, the cocking mechanism preferably includes one of a rotary crank, a lever, or a motor that rotates the pulley assemblies.

In another embodiment, the cocking mechanism includes at least one cocking, rope that moves the cocking, mechanism and the draw string from the released configuration to the drawn configuration.

In another embodiment, the cocking mechanism includes channels configured to receive the draw string during movement between the released configuration and the drawn configuration. The cocking mechanism preferably includes a de-cocking actuator that releases the draw string from the trigger assembly onto the channels so the user can move the draw string from the drawn configuration to the released configuration.

The cocking mechanism is preferably captured to slide in the center rail.

In another embodiment, couplings are interposed between at least one of the distal portions or the proximal portions of the first and second limbs and the respective limb mounts that provides limb relief as the draw string is moved to the drawn configuration. The couplings preferably include rotating translation arms pivotally attached to one of the distal portions or the proximal portions of the first and second limbs and the respective limb mounts. In another embodiment, rotation of the rotating translation arms are synchronized by a synchronization assembly. The couplings may include pivoting couplings, linkage couplings, rotating couplings, sliding couplings, elastomeric couplings, or a combination thereof. In another embodiment, the frame provides limb relief between the proximal portion and the distal portion of the limbs.

The distal and proximal portions of the first and second limbs can be coupled to the riser or the center rail. The first and second limbs can be arranged in a concave or convex configuration with respect to the frame.

DETAILED DESCRIPTION OF THE INVENTION

FIGS. 1-4 are perspective views of an energy storage device 50 for a projectile launching system in accordance with an embodiment of the present disclosure. Center support 52 includes a first pair of distal and proximal limb mounts 54A, 56A located on a first side 58A of center plane 60 and a second pair of distal and proximal limb mounts 54B, 56B located on a second side 58B on the second side of the center plane 60.

The center support 52 can be a single piece or a multi-component construction. In the illustrated embodiment, the center support 52 includes a pair of machined center rails 52A, 52B coupled together with fasteners, and a pair of finger guards 53A, 53B also attached to the center rails 52A, 52B using fasteners. The components 52, 53 are preferably constructed from a light weight metal, such as high grade aluminum. As will be discussed below, the center support 52 will include a variety of additional features, such as cut-outs and mounting holes, to accommodate other components such as a trigger mechanism, cocking mechanism, stock, arrow storage, and the like (see e.g., FIG. 12B).

Figure 3:
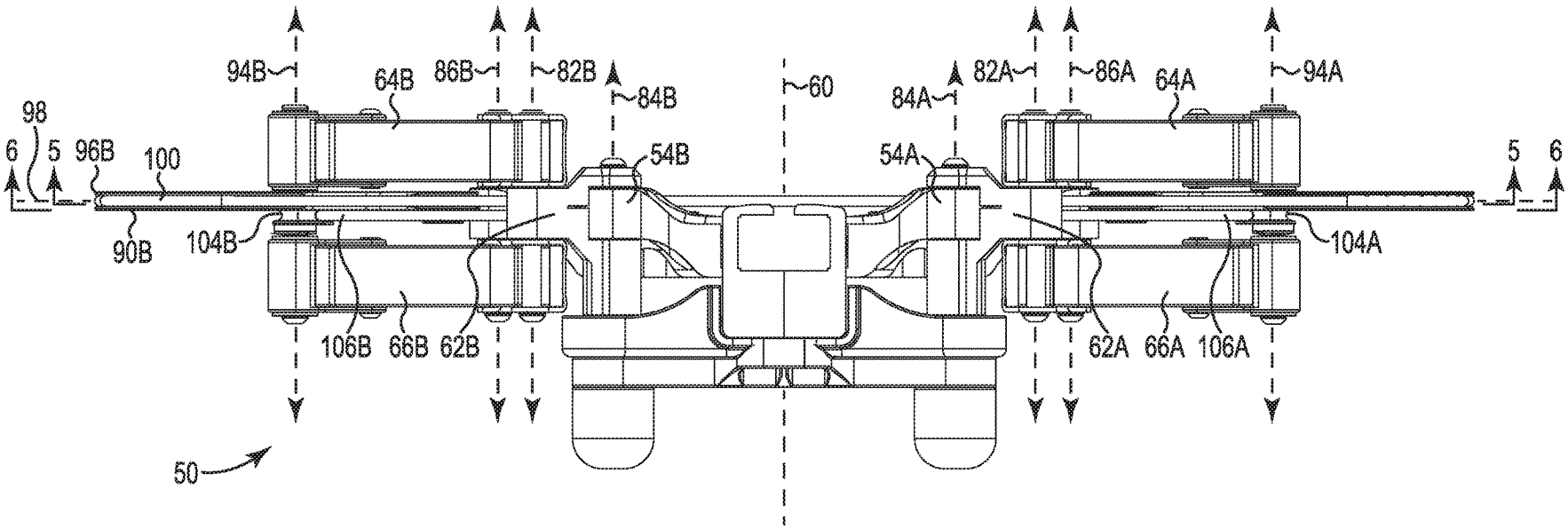
FIG. 3 is a front view of the energy storage system of FIG. 1.
Figure 4:
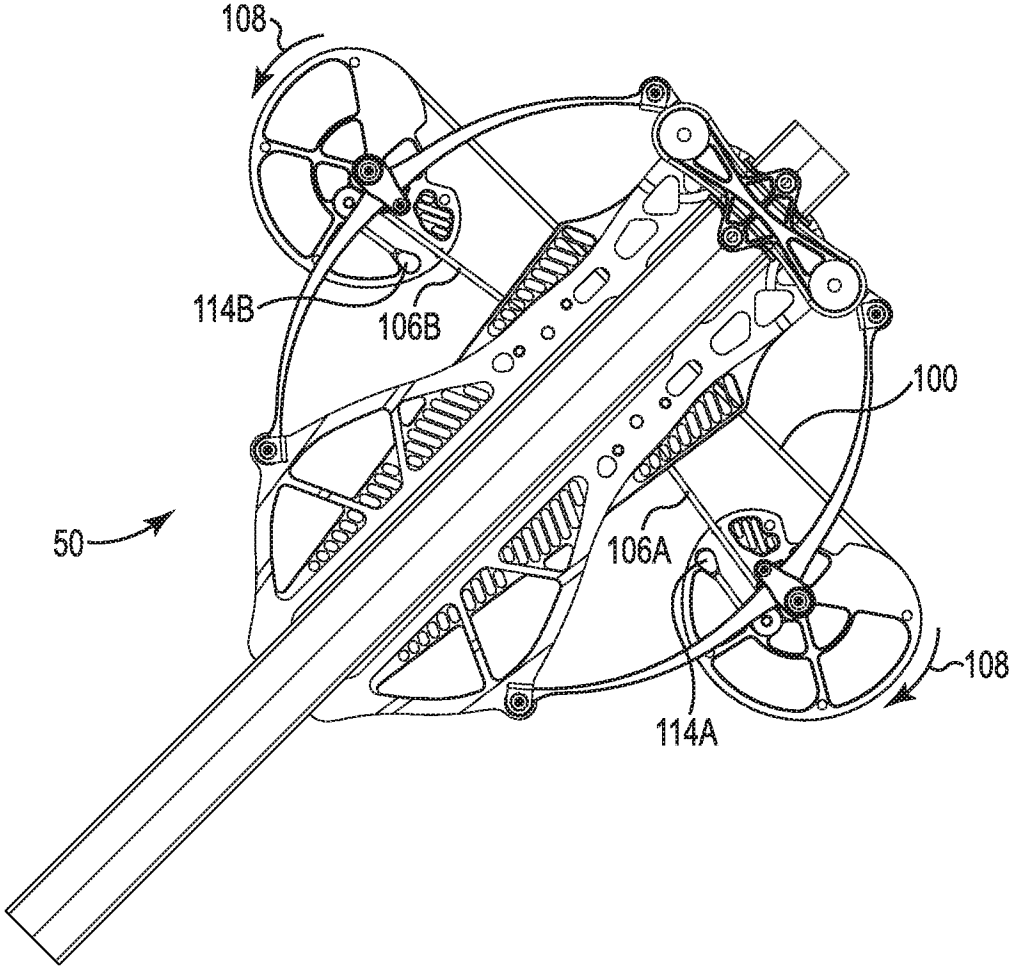
FIG. 4 is a bottom view of the energy storage system of FIG. 1.

In the illustrated embodiment, limbs 64A, 66A are located on first side 58A of the center plane 60 and limbs 64B, 66B are located on the second side 58B. Proximal portions 68A, 68B ("68") of the limbs 64A, 66A are coupled to the proximal limb mount 54A in the finger guard 53A, such as by pivot pin 70 and pivot brackets 72. Proximal portions 74A, 74B ("74") of the limbs 64B, 66B are coupled to the proximal limb mounts 56B in the finger guard 53B by pivot pin 70 and pivot brackets 72. As illustrated in FIG. 3, the proximal portions 68, 74 rotate on axes 86A, 86B ("86") relative to the center support 52 to provide a pivoting or rotating coupling.

In the illustrated embodiment, translation arms 62A, 62B ("62") are pivotally attached to the distal limb mounts 54A, 54B in the finger guards 53A, 53B, respectively. Distal portions 76A, 76B ("76") of the limbs 64A, 66A are coupled to the translation arm mount 78A, such as by pivot pin 70 and pivot brackets 72. Distal portions 80A, 80B ("80") of the limbs 64B, 66B are coupled to the translation arm mount 78B by pivot pin 70 and pivot brackets 72. The distal portions 76, 80 rotate on axes 82A, 82B, ("82") relative to the translation arm mounts 78A, 78B, respectively. The translation arms 62A, 62B rotate on axes 84A, 84B ("84"), respectively, relative to the center support 52 (see, FIG. 3). The translation arms 62 to provide a linkage coupling between the limbs 64, 66 and the center support 52.

As used herein, "coupled" or "coupling" refers to a connection, between a limb, and a center support. Both positive coupling and dynamic coupling are possible. "Positively coupled" or "positive coupling" refers to a limb continuously engaged with a center support. "Dynamically coupled" or "dynamic coupling" refers to a limb engage with a center support only when a certain level of tension is applied to a draw string. The coupling can be a rigid coupling, a sliding coupling, a pivoting coupling, a linkage coupling, a rotating coupling, an elastomeric coupling, or a combination thereof.

Figure 1:
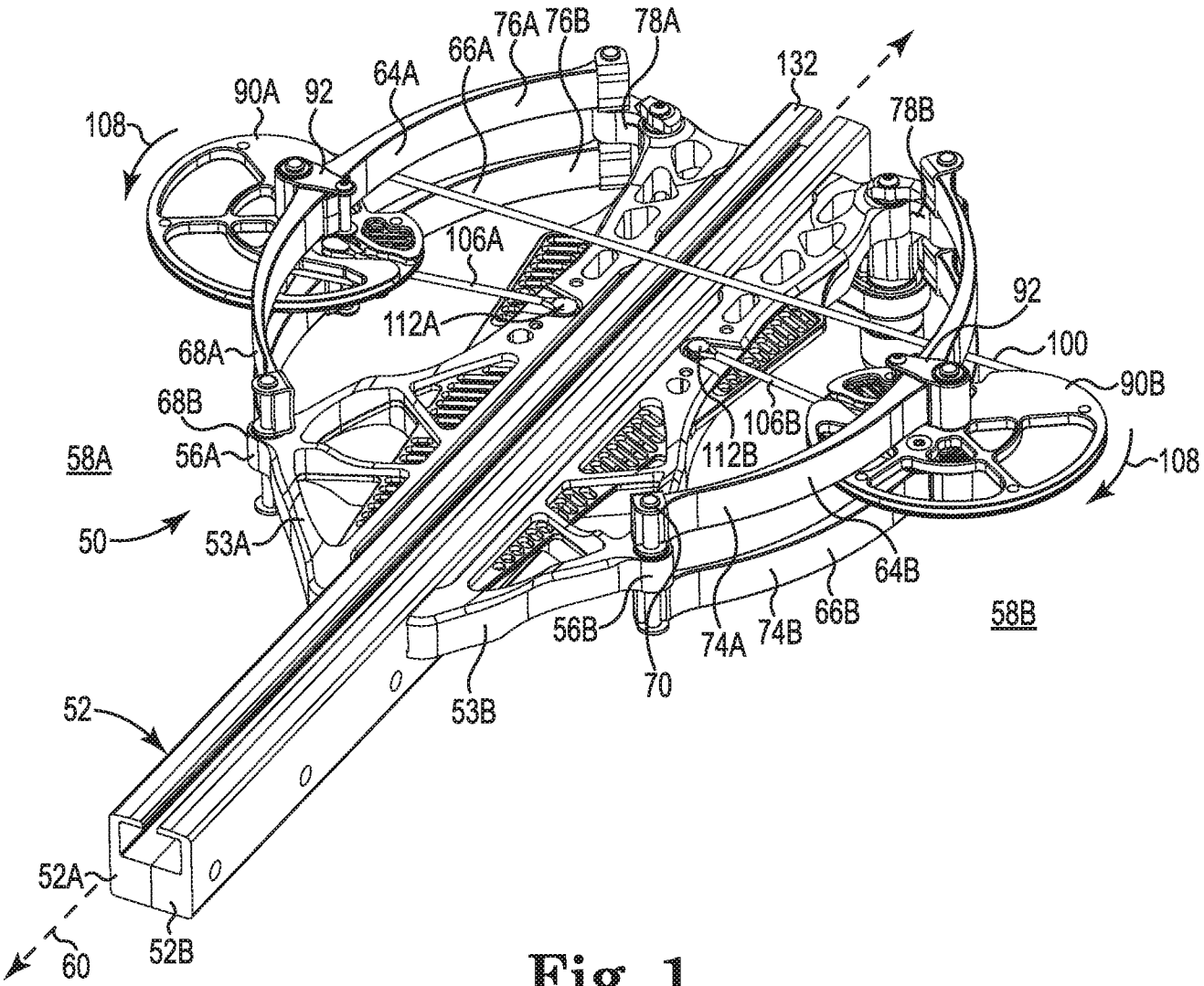
FIG. 1 is a perspective view of an energy storage system in accordance with an embodiment of the present disclosure.
Figure 2:
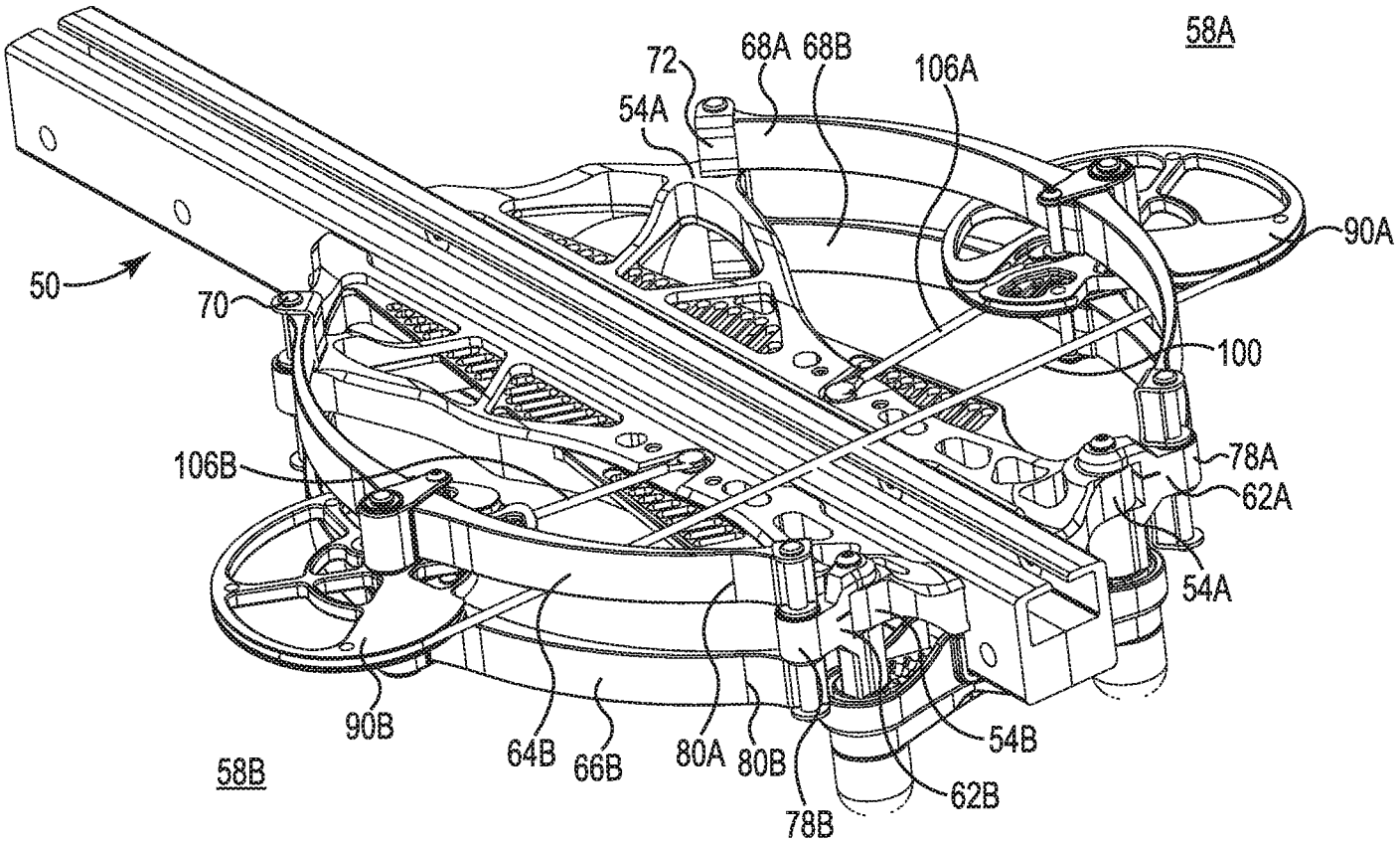
FIG. 2 is an, alternate perspective view of the energy storage system of FIG. 1.

For example, in the embodiment of FIG. 1, both ends of the limbs 64, 66 are positively coupled to the center support 52. The proximal ends 68, 74 use a rotating or pivoting coupling and the distal portions 76, 80 use a linkage coupling.

Figure 8:
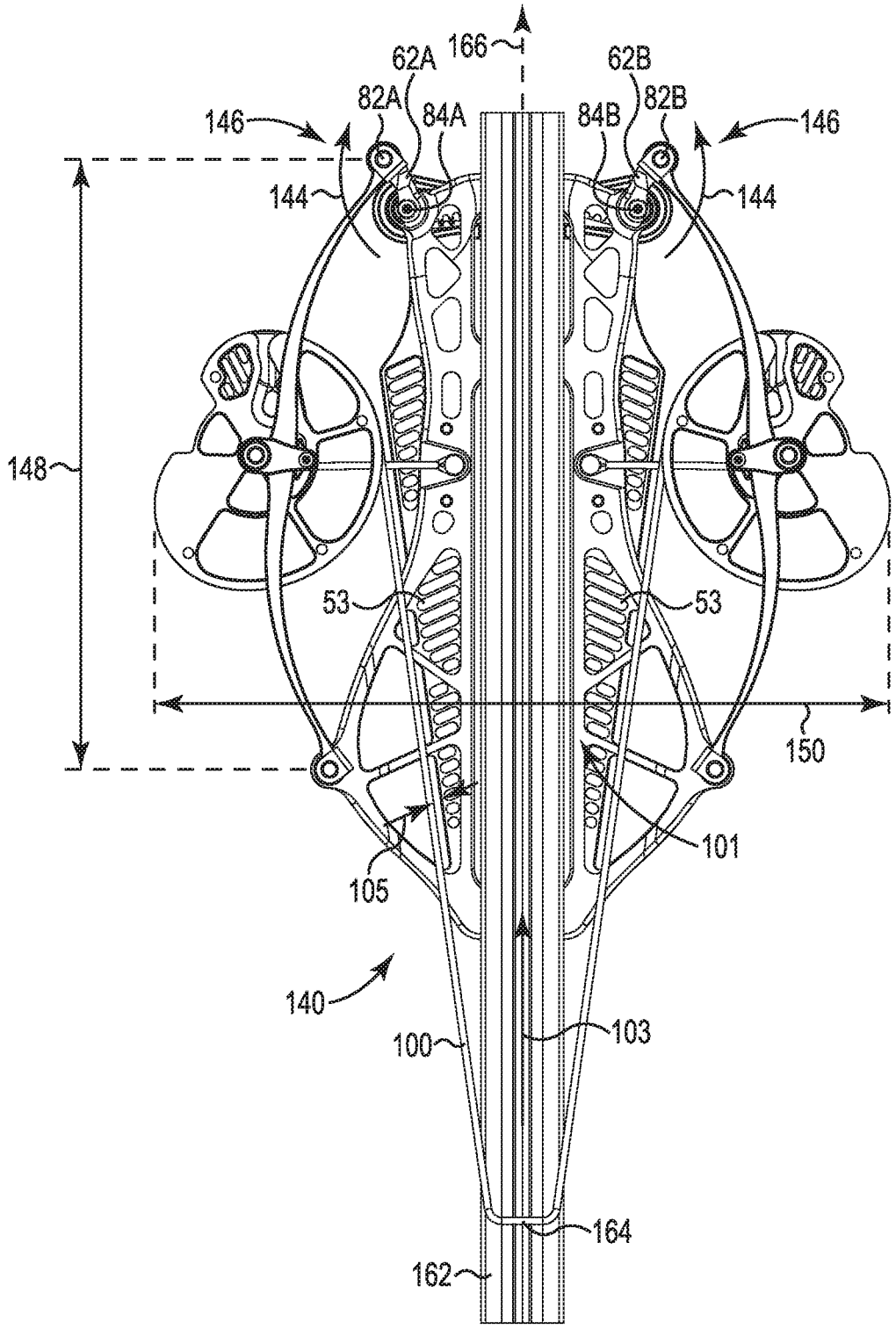
FIG. 8 is a top view of the energy storage system of FIG. 1 in a drawn configuration in accordance with the embodiment of the present disclosure.

As illustrated in FIG. 8, the inward deformation of the limbs 64, 66 forces the translation arms 62 to rotate in distal directions 144 around pivot axes 84 to extended position 146. The translation arms 62 provide limb relief between the distal portions 74 and the proximal portion 68 of the limbs 64, 66. As used herein, "limb relief" means displacement between a proximal portion of a limb relative to a distal portion of the limb when a certain level of tension is applied to a draw string. The displacement can be translation, rotation, flexure, or a combination thereof, occurring at either or both ends of the limbs. The limb relief is typically provided by the couplings and/or the center support 52.

Various structures for providing limb relief are discussed herein. For example, limb relief can be provided by locating pivot arms 62 between proximal portions 68, 74 of the limbs 64, 66 and the proximal limb mounts 54. In yet another embodiment, limb relief is provided by pivot arms 62 located at both the distal portions 76, 80 and the proximal portions 68, 74 of the limbs 64, 66.

In an alternate embodiment, the translation arms 62 are replaced with elastomeric members that are rigidly attached to the finger guard 53. Limb, relief is achieved by elastic deformation of the elastomeric translation arms. In another embodiment, limb relief is provided by a combination of deformation and rotation of the elastomeric translation arms 62 (see e.g., FIG. 16).

In yet another embodiment, one or both of the distal and proximal limb mounts 54, 56 are configured as slots with an elastomeric bushing to provide the limb relief.

Figure 19B:
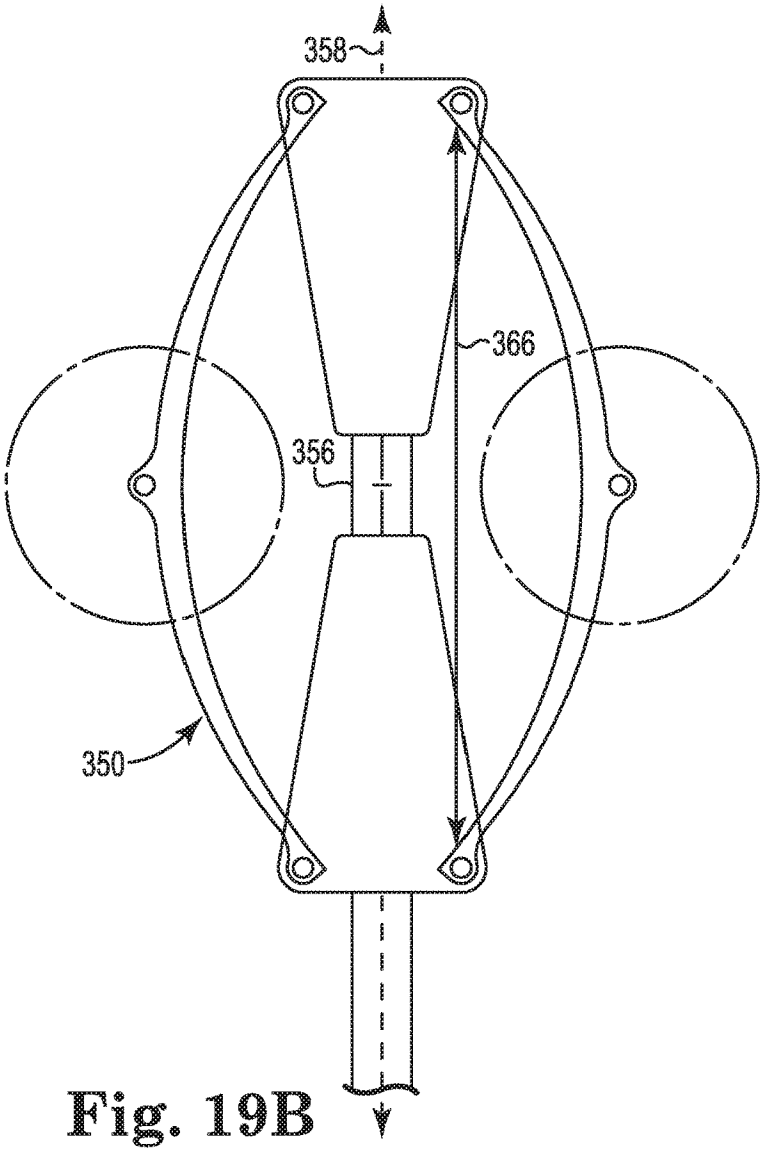
FIGS. 19A and 19B an energy storage portion for a bow with a center support that, provides limb relief in accordance with an embodiment of the present disclosure.
Figure 19A:
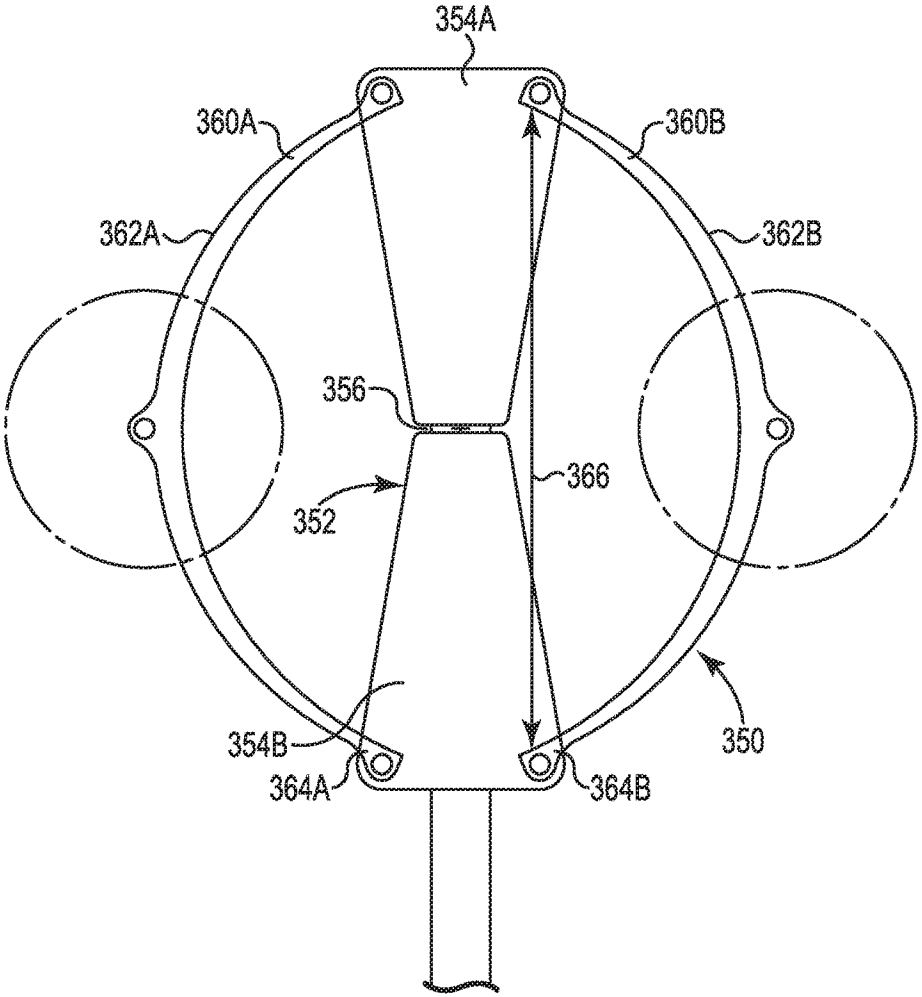

In yet another embodiment, limb relief is provided by the center support 52 (see e.g., FIGS. 19A and 19B).

First pulley assembly 90A is pivotally coupled to the first limbs 64A, 66A at a location between the proximal and distal portions 68, 76. Second pulley assembly 90B is pivotally coupled to the second limbs 64B, 66B at a location between the proximal and the distal, portions 74, 80. As best illustrated in FIG. 3, the first and second pulley assemblies 90A, 90B rotate around axes 94A, 94B. In the illustrated embodiment, the first pulley assembly 90A is located between the limbs 64A, 66A and the second pulley assembly 90B is located between the limbs 64B, 66B.

As used herein, the term "pulley" is refers generically to a member rotating around an axis that is designed to support movement of a flexible member, such as a rope, string, belt, chain, and the like. Pulleys typically have a groove, channel or journal located between two flanges around at least a portion of its circumference that guides the flexible member. Pulleys can be round, such as a drum or a sheave, or non-round, such as a cam. The axis of rotation can be located concentrically or eccentrically relative to the pulley.

As best illustrated in FIG. 3, the pulleys 90A, 90B include draw string journals 96A, 96B ("96") configured to receive draw string 100. The draw string journals 96 are located in plane 98 that is located above top surface 102 of the center support 52. As will be discussed below, the draw string journals 96 are arranged so that the string 100 travels close to the top surface 102 of the center support 52 between a release configuration 130 and a drawn configuration 140 (See FIGS. 7 and 8). The pulleys 90 also include power string journals 104A, 104B ("104") configured to receive power strings 106A, 106B that are located below and, generally parallel to the draw string journals 96. As used herein, "string" refers generically to any flexible member, such as woven and non-woven filaments of synthetic or natural materials, cables, belts, chains, and the like.

Figure 5:
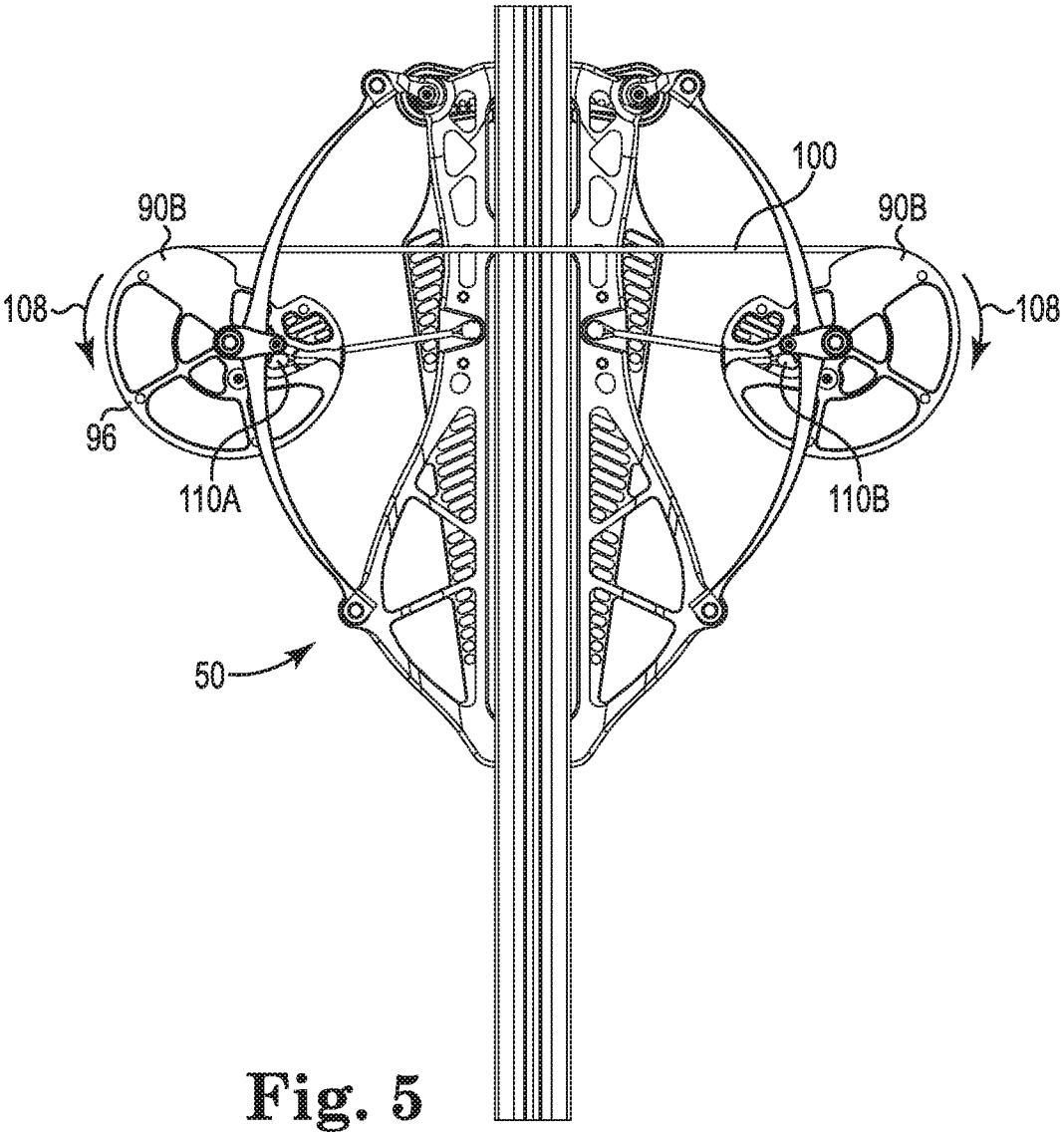
FIG. 5 is a sectional view showing the draw string of the energy storage system of FIG. 1 in a released configuration.

FIG. 5 is a sectional view of the energy storage device 50 showing the path of the draw string 100 on the pulley assemblies 90 in the released configuration 130. The draw string 100 wraps around distal portions of the draw string journals 96 in direction 108 and the ends of the draw string 100 are attached to anchors 110A, 110B on the pulleys 90A, 90B, respectively. In the illustrated embodiment, the draw string 100 crosses over the center support 52 only once.

Figure 6:
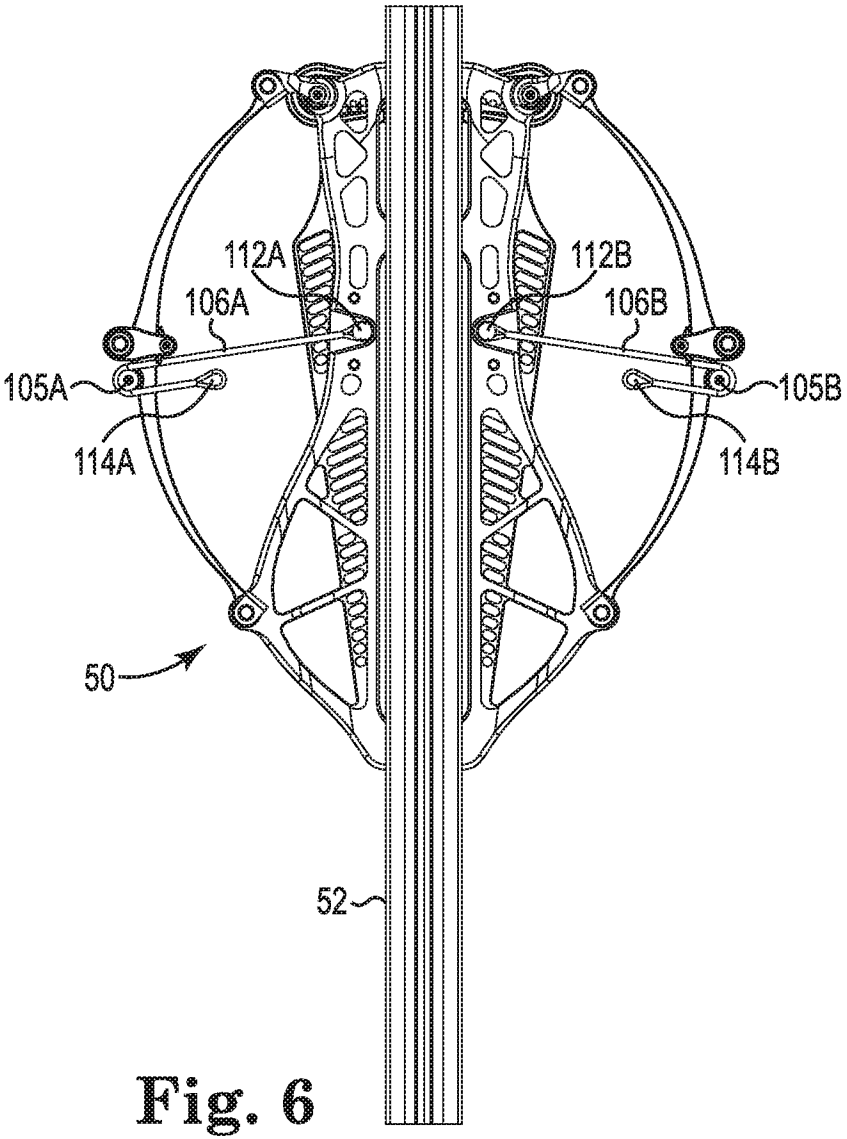
FIG. 6 is a sectional view showing the power strings of the energy storage system of FIG. 1 in the release configuration.

FIG. 6 is a sectional view of the energy storage device 50 showing the path of the power strings 106A, 106B in the release configuration 130. The power strings 106 attach to the center support 52 by anchors 112A, 112B and wrap around distal portions of the power string pulleys 105A, 105B, respectively. The opposite ends of the power strings 106A, 106B are attached to the pulleys 90A, 90B (not shown) by anchors 114A, 114B, respectively. In the illustrated embodiment, the power strings 106 do not cross over the center support 52.

The geometric profiles of the draw string journals 96 and the power string journals 104 contribute to let-off at, full draw. The configuration of the limbs 64, 66 and the limb relief of the limbs 64, 66 to the center support 52 also contribute to let-off A more detailed discussion of cams suitable for use in bows is provided in U.S. Pat. No. 7,305,979 (Yehle), which is hereby incorporated by reference.

Figure 7:
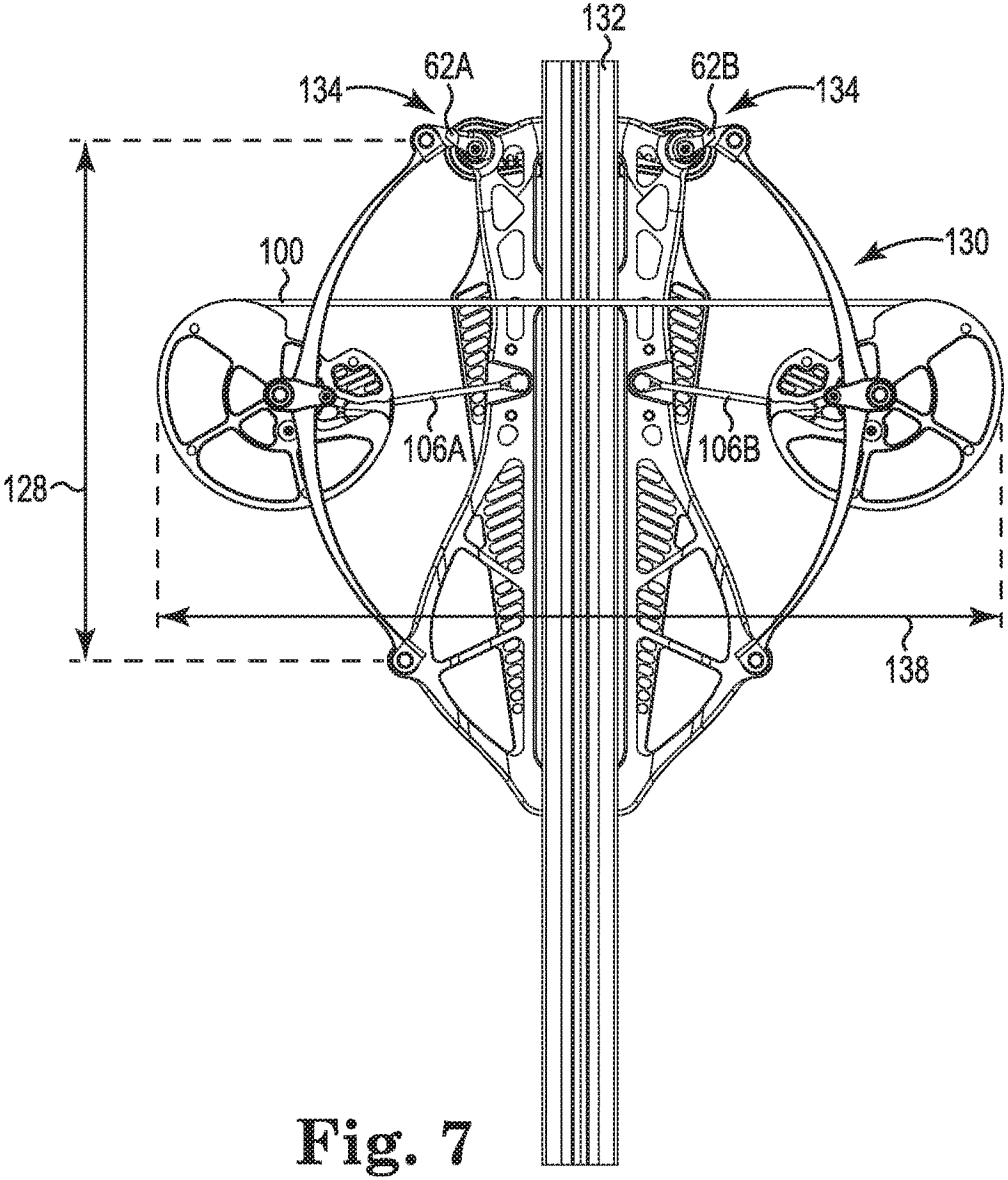
FIG. 7 is a top view of the energy storage system of FIG. 1 in a released configuration in accordance with the embodiment of the present disclosure.

FIG. 7 is a top view of the energy storage device 50 in a released configuration 130 with the draw string 100 in its forward most position relative to the distal end 132 of the center support 52. Static tension between the draw string 100 and the power strings 106 is opposed by slight flexure of the limbs 64, 66 to maintain the translation arms 62 in retracted position 134.

In the retracted position 134 the translation arms 62 are rotated back toward proximal end 136 of the center support, with the limbs 64, 66 in a generally concave configuration with respect to the center support 52. In the release configuration 130 distance 128 between the proximal limb mounts 56 and the translation arm mounts 78 is at a minimum and width 138 of the energy storage device 50 is at its maximum.

FIG. 8 is a top view of the energy storage device 50 with the draw string 100 in a drawn configuration 140. The process of drawing the draw string 100 toward the proximal end 136 of the center support 52 simultaneously causes the pulley assemblies 90 to rotate in directions 142 and the limbs 64, 66 to deform inward toward the center support 52.

In the illustrated embodiment, the limb relief increases the distance 148 between the proximal limb mounts 56 and the translation arm mounts 78 to be greater than the distance 128 (see FIG. 5). In the drawn configuration 140 distance 148 between the proximal limb mounts 56 and the translation arm mounts 78 is at a maximum and width 150 of the energy storage device 50 is at a minimum. The distance 148 in the drawn configuration 140 is greater than the distance 128 in the released configuration 130. The width 150 in the drawn configuration is less than the width 138 in the released configuration 130.

Operation of the illustrated embodiment includes locating an arrow or bolt in groove 162 with knock engaged with the draw string 100 in location 164. Release of the draw string 100 causes the limbs 64, 66 to return to the released configuration 130, thereby launching the bolt in direction 166.

As best illustrated in FIG. 8, the finger guards 53 is configured to extend to at least space 101, which corresponds to the space traversed by the draw string 100 from the drawn configuration 140 to the released configuration 130. The finger guard 53 is configured to reduce the chance of a user's finger extending up from the bottom of the center support 52 and into the path 103 of the draw string 100 from the drawn configuration 140 to the released configuration 130. In the preferred embodiment, the finger guard 53 completely blocks access from the bottom of the center support 52 to the space 101. In another embodiment, gap 105 between the draw string 100 and the finger guards 53 is less than about 0.5 cm.

The energy storage device 50 typically includes a trigger assembly to retain the draw string 100 in the drawn configuration 140 and a stock located near the proximal end 136 of the center support 52. Most trigger assemblies include a dry fire mechanism that prevents release of the draw string 100 unless a bolt is positioned in the center support 52. Suitable trigger assemblies and stocks are disclosed in U.S. Pat. No. 8,240,299 (Kronengold et al.); U.S. Pat. No. 8,104,461 (Kempf): U.S. Pat. No. 8,033,275 (Bendar et al.); U.S. Pat. No. 8,020,543 (Maleski et al.); U.S. Pat. No. 7,836,871 (Kempf); U.S. Pat. No. 7,810,480 (Shepley et al.); U.S. Pat. No. 7,770,567 (Yehle); U.S. Pat. No. 7,743,760 (Woodland); U.S. Pat. No. 7,363,921 (Kempf); U.S. Pat. No. 7,328,693 (Kempf); U.S. Pat. No. 7,174,884 (Kempf et al.); U.S. Pat. No. 6,736,123 (Summers et al.); U.S. Pat. No. 6,425,386 (Adkins); U.S. Pat. No. 6,205,990 (Adkins); U.S. Pat. No. 5,884,614 (Darlington et al.); U.S. Pat. No. 5,649,520 (Bednar); U.S. Pat. No. 5,598,829 (Bednar); U.S. Pat. No. 5,596,976 (Wailer); U.S. Pat. No. 5,085,200 (Horton et al.); U.S. Pat. No. 4,877,008 (Troubridge); U.S. Pat. No. 4,693,228 (Simonds et al.); U.S. Pat. No. 4,479,480 (Holt); U.S. Pat. No. 4,192,281 (King); and U.S. Pat. No. 4,030,473 (Puriyear), which are hereby incorporated by reference.

Figure 9:
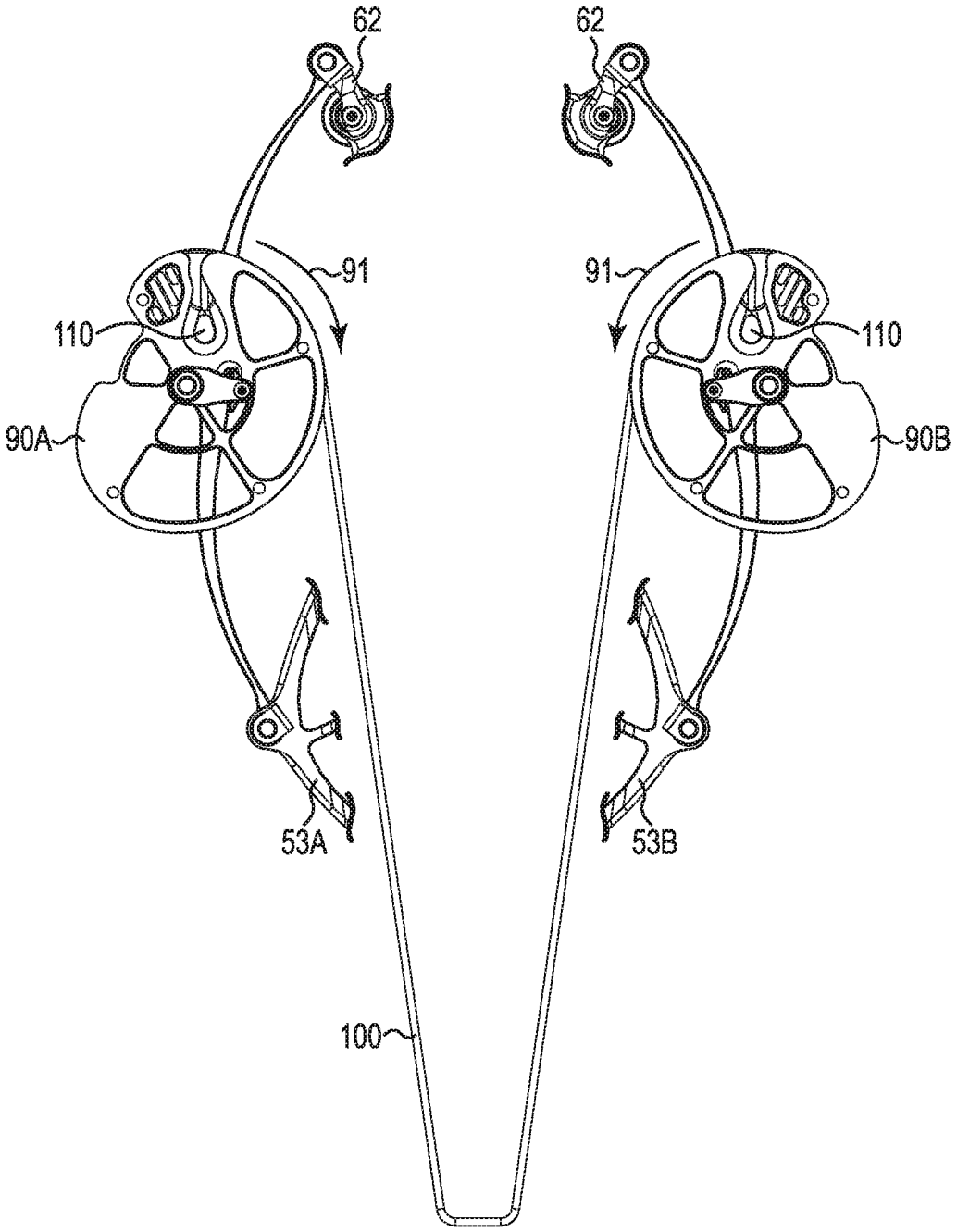
FIG. 9 is a sectional view showing the draw string of the energy storage system of FIG. 1 in a drawn configuration.

FIG. 9 is a sectional view of FIG. 8 with the center support 52 removed to better illustrate the path of the draw string 100 in the drawn configuration 140. The pulley assemblies 90 are rotated in direction 91 until the draw string is fully drawn.

Figure 10:
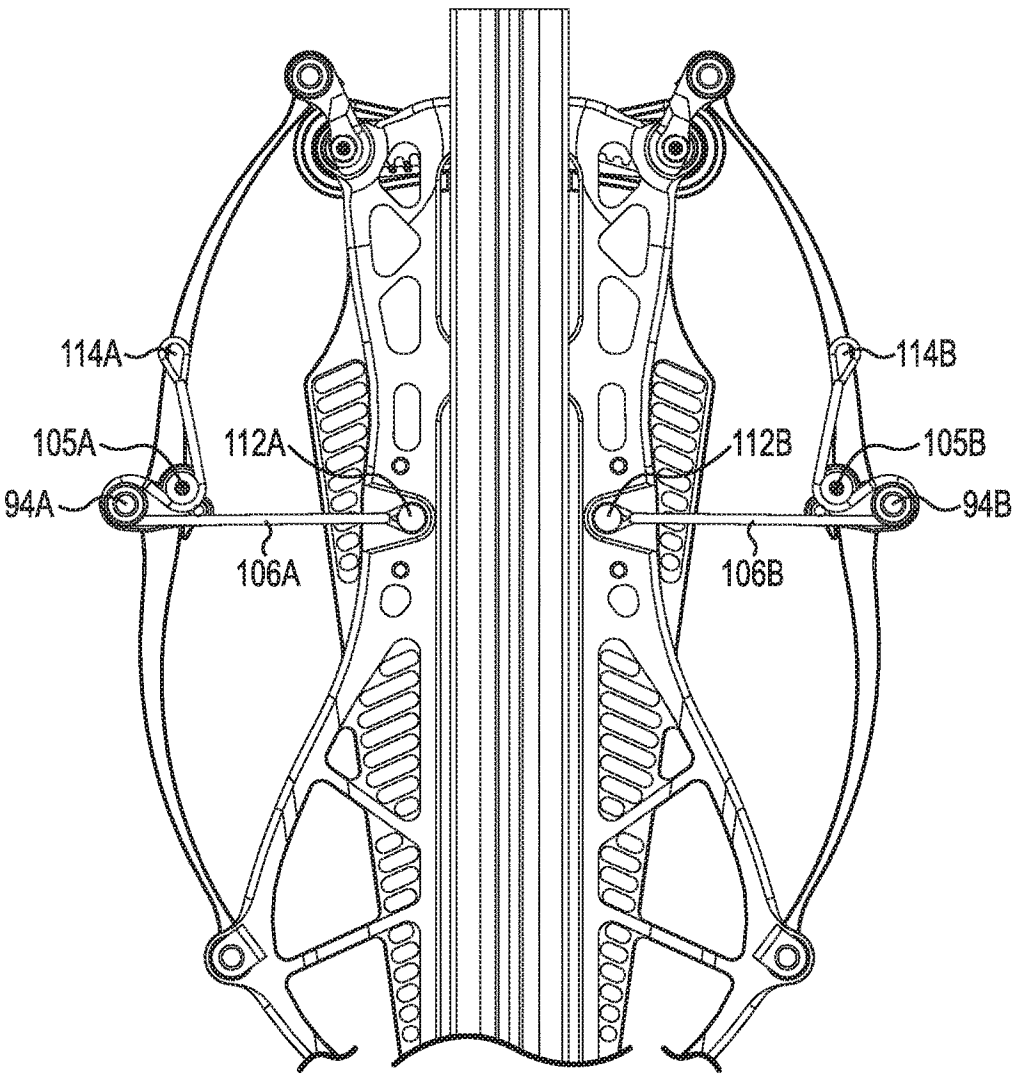
FIG. 10 is a sectional view showing the power strings of the energy storage, system of FIG. 1 in the drawn configuration.

FIG. 10 is a sectional view of FIG. 8 with the draw string pulleys removed to illustrate the path of the power strings 106 in the drawn configuration 140. The power strings 106 wrap around the power pulleys 105 in a first direction and around the pivot axes 94 of the pulley assemblies 90 in the opposite direction, terminating at anchors 112, as discussed above.

Figure 11:
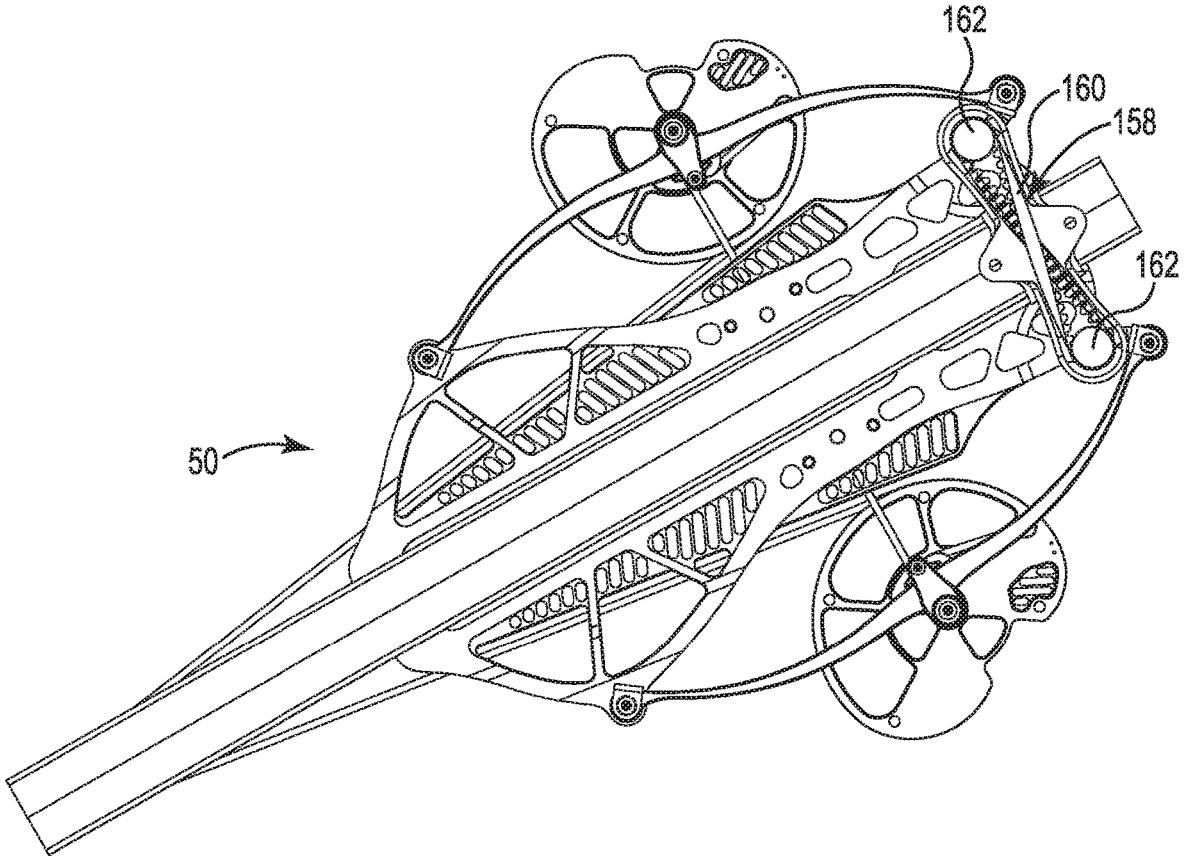
FIG. 11 is a bottom view of the energy storage system of FIG. 1 showing a timing belt in accordance with an embodiment of the present disclosure.

FIG. 11 is a bottom sectional view of the energy storage device 50 with synchronization assembly 158 exposed. In the illustrated embodiment, the synchronization assembly 158 includes timing belt 160 wrapped around pulleys 162 that are coupled to the rotation of the translation arms 62. The timing belt 160 synchronizes the rotation of the translation arms 62 (see FIG. 6A) between the retracted position 134 and the extended position 146. In the illustrated embodiment, the timing belt 460 is a toothed belt twisted into a figure eight configuration. Alternate synchronization assemblies can include gears, belts, cables, chains, linkages, and the like.

Figure 12A:
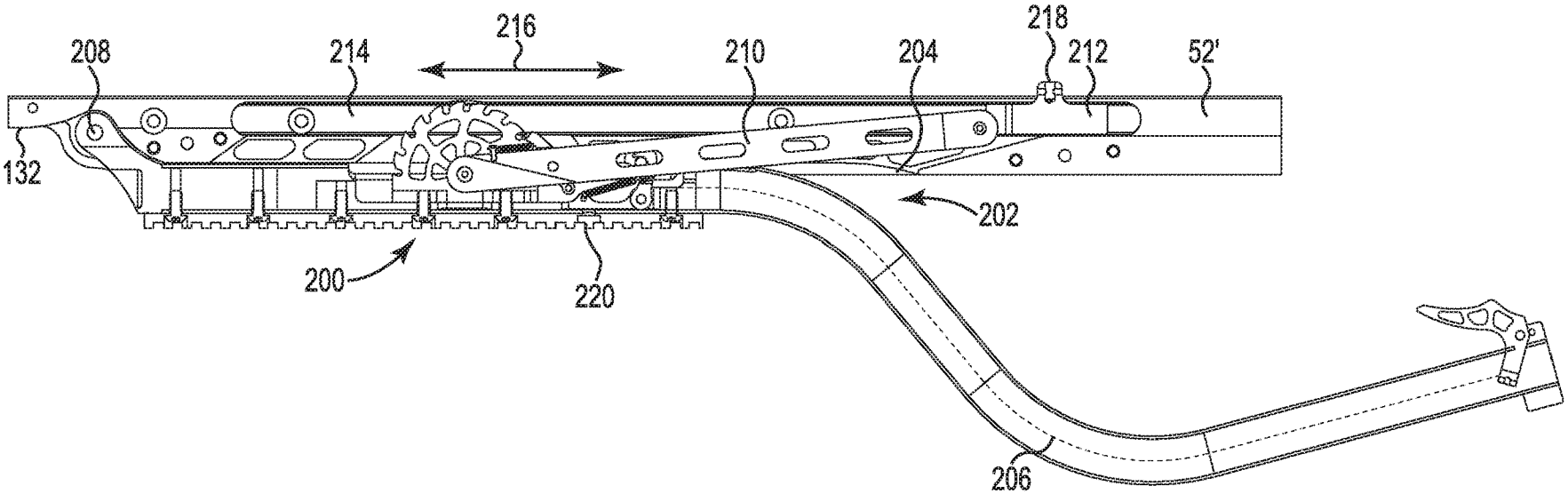
FIG. 12A is a sectional view of a center support with a cocking, system in accordance with an embodiment of the present disclosure.
Figure 12B:
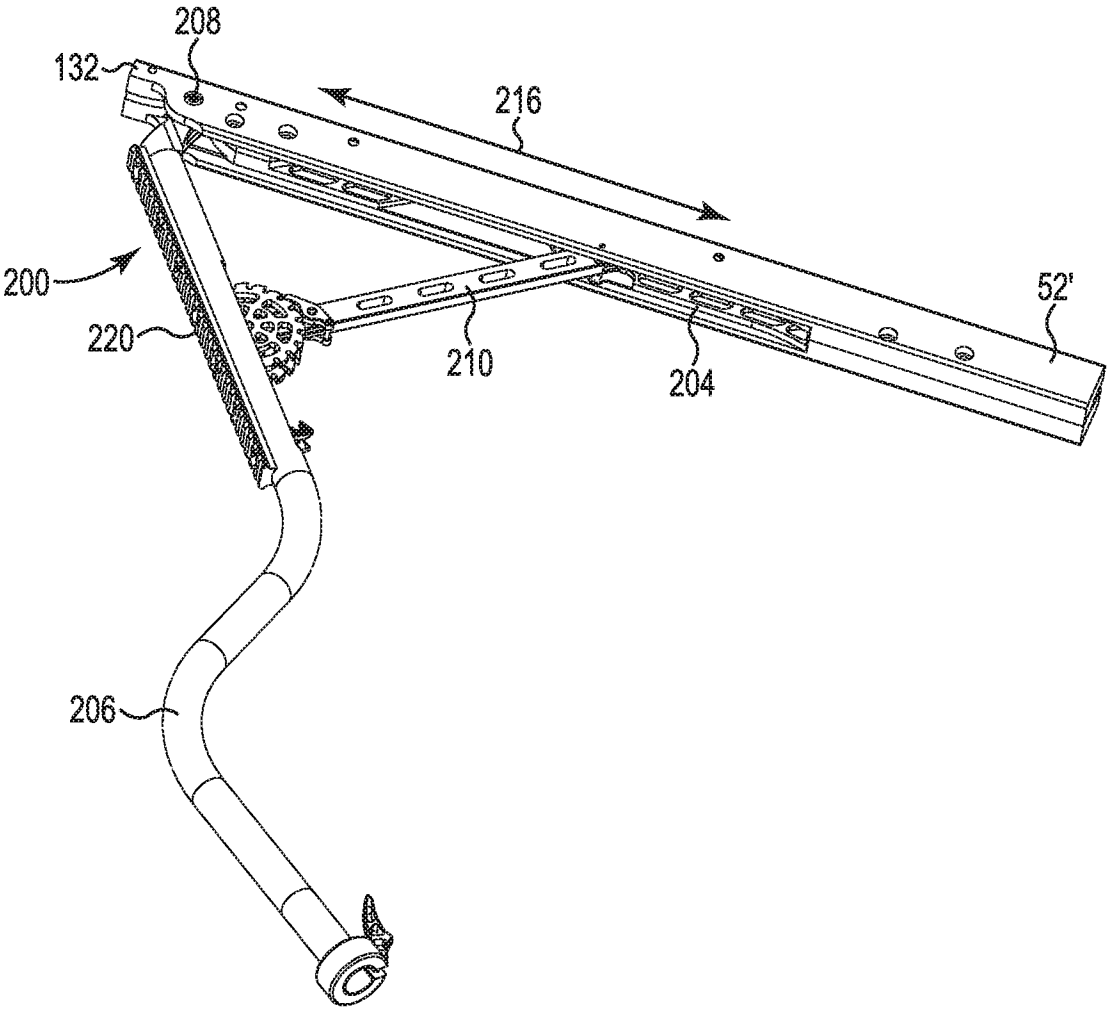
FIG. 12B is perspective view of the center support of FIG. 12A.

FIG. 12A is a sectional view of an alternate center support 52' modified to include cocking mechanism 200 shown in a closed and locked configuration 202 in accordance with an embodiment of the present disclosure. FIG. 12B is a perspective view of the center support 52' with the cocking mechanism 200 in a partially opened configuration.

The center support 52' is machined to create opening 204 that receives the cocking mechanism 200. The cocking mechanism 200 includes an elongated tube 206 pivotally attached to the center support 52' at location 208 near the distal end 132. Arm 210 pivotally couples the elongated tube 206 to traveler 212 that slides back and forth along axis 216 in channel 214 formed in the center support 52'. The traveler 212 includes finger 218 that captures the draw string 100 to move it from the released configuration 130 to the drawn configuration 140 and into engagement with a trigger assembly (not shown) In the illustrated embodiment, the elongated tube 206 includes a conventional accessory rail 220, used to attach various accessories to the center support 52', such as forward grips, laser sights, and the like.

Figure 13:
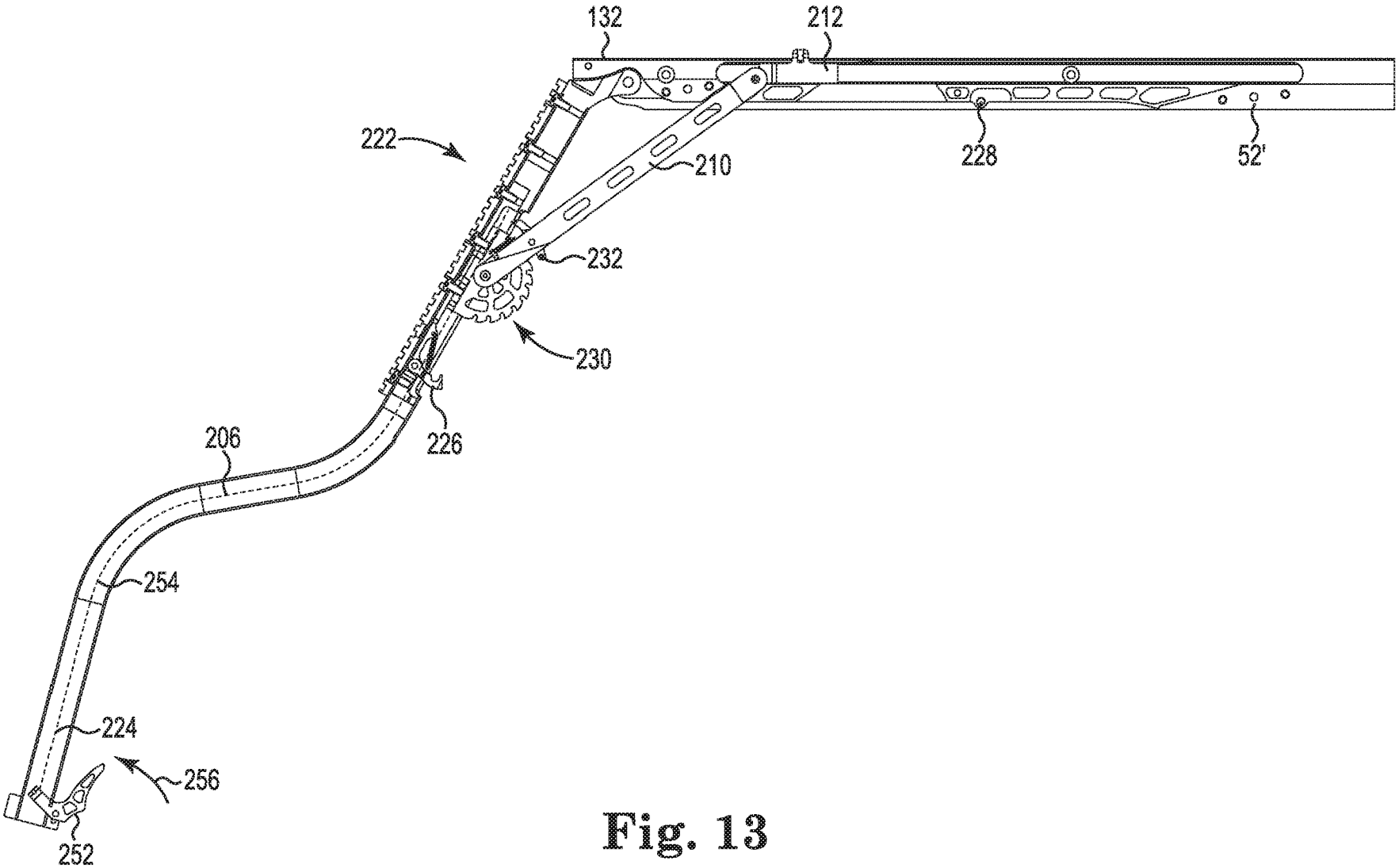
FIG. 13 is a sectional view of the cocking mechanism of FIG. 12A in a fully open configuration in accordance with an embodiment of the present disclosure.

FIG. 13 is a sectional view of the center support 52' in a fully open configuration 222. The arm 210 advances the traveler 212 to the distal end 132 of the center support 52' to capture the draw string 100. In order to cock the energy storage device 50, the user grasps proximal end 224 of the elongated tube 206 and returns it to the closed and locked configuration 202. Latch 226 engaged with pin 228 on the center support 52' to lock the cocking mechanism 200 in the closed and locked configuration 202.

The limbs 64, 66 resist movement of the elongated tube 206 back to the closed and locked configuration 202. If the user inadvertently releases the elongated tube 206 during this process, it will snap back to the fully open configuration 222 with considerable force. Ratcheting mechanism 230 prevents this outcome.

Figure 14:
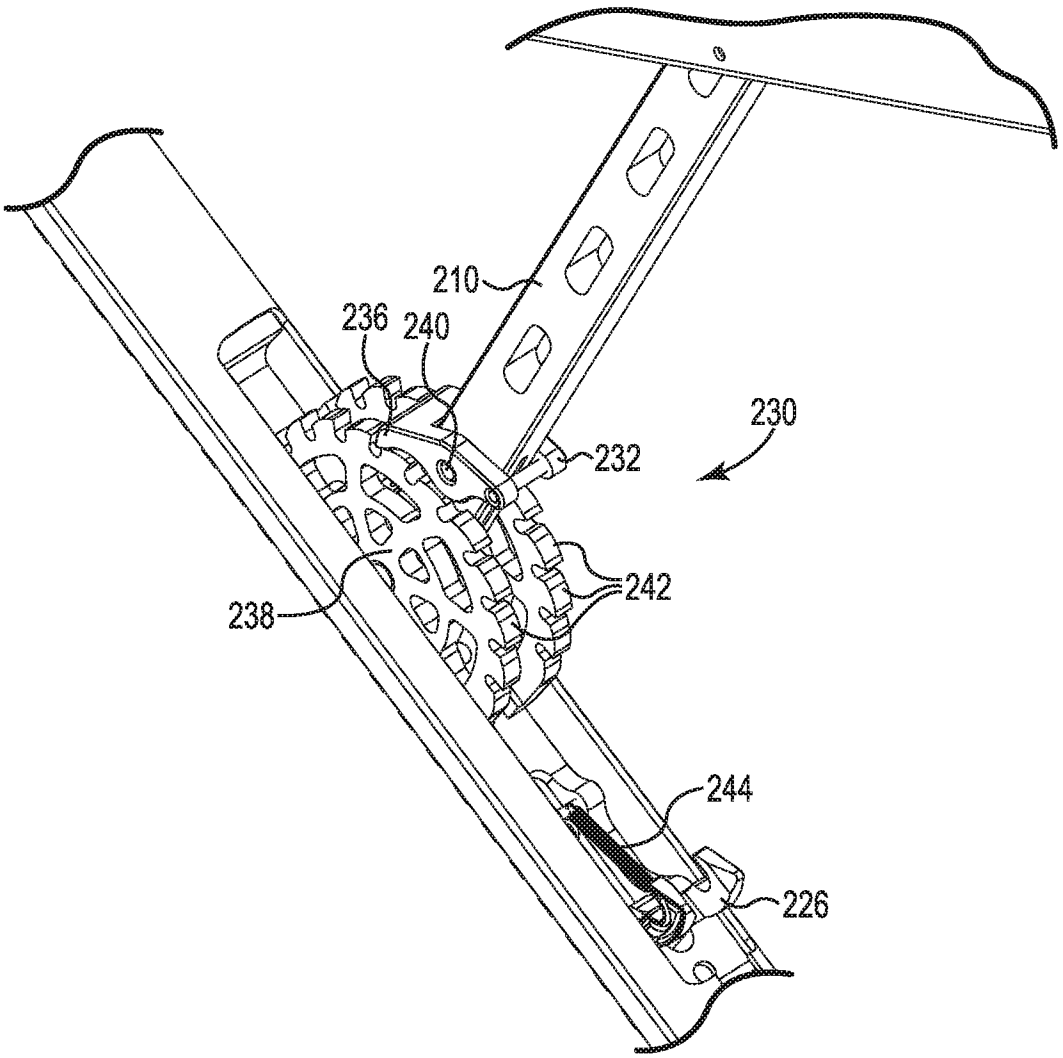
FIG. 14 is a perspective view of a ratcheting mechanism for a cocking mechanism in accordance with an embodiment of the present disclosure.
Figure 15:
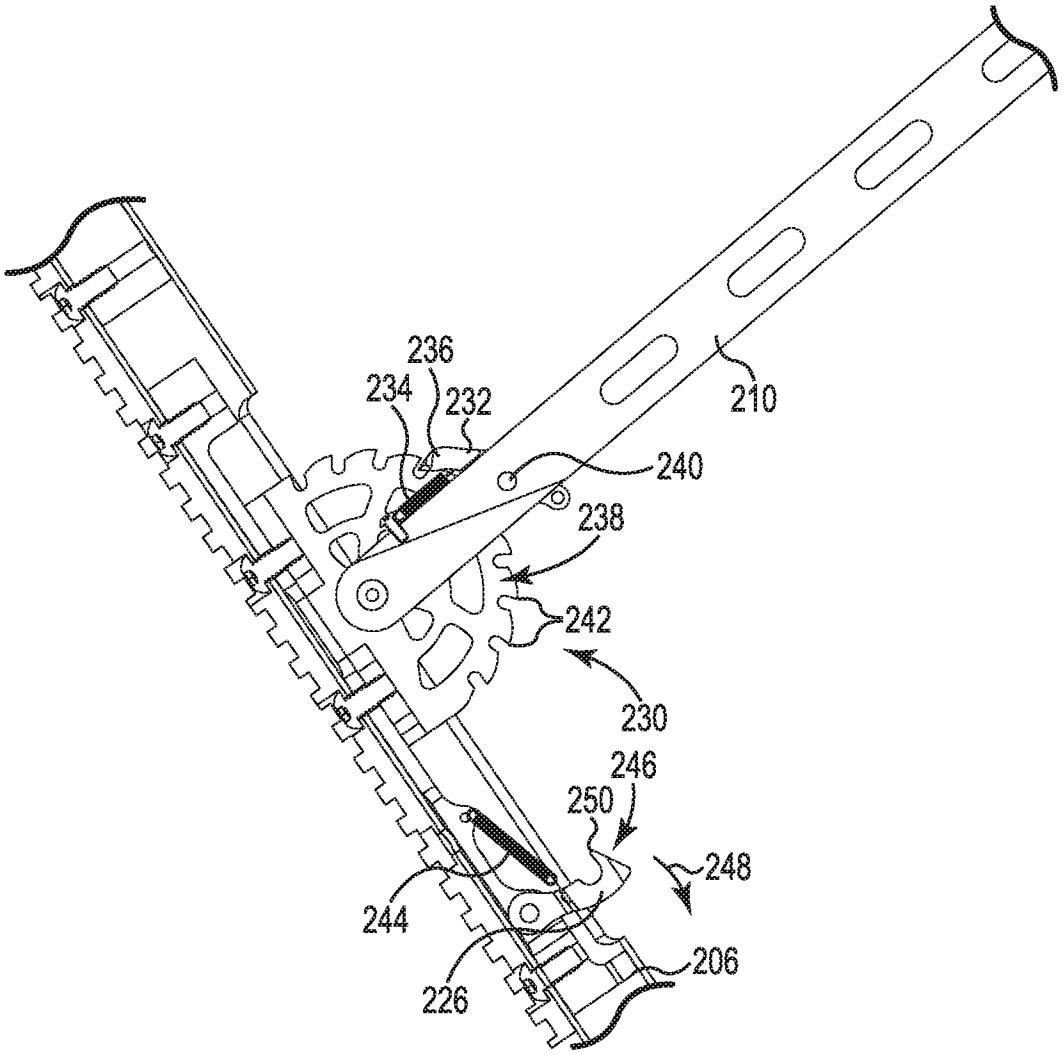
FIG. 15 is a sectional view of the ratcheting mechanism of FIG. 14.

As best illustrated in FIGS. 14 and 15, the ratcheting mechanism 230 includes pawl 232 pivotally attached to the arm 210. Spring 234 biases distal end 236 of the pawl 232 into engagement with tooth members 238 that are mounted to the elongated tube 206. As the elongated tube 206 is moved to the closed and located configuration 202, the pawl 232 rocks up and down around pivot 240 to sequentially engage with teeth 242. As a result, inadvertent release of the elongated tube 206 does not result in the cocking mechanism 200 returning to the fully open configuration 222.

Also illustrated in FIGS. 14 and 15 is, additional detail for the latch 226. Spring 244 biases the latch 226 in a locked configuration 246. As the elongated tube 206 is pushed to the closed and locked configuration 222, the latch 226 is pushed by the pin 228 in direction 248 until the pin 228 clears tip 250, at which point the latch 226 returns to the locked configuration 246.

As illustrated in FIG. 13, operation of the pawl 232 and the latch 226 is simultaneously controlled by thumb trigger 252 located near proximal end 224 of the elongated tube 206. In the illustrated embodiment, cable 254 is attached to the thumb trigger 252 and both of the pawl 232 and the latch 226. Depressing the thumb trigger 252 in direction 256 disengages the pawl 232 from the teeth 242 and the latch 226 from the pin 228, respectively. Various alternate cocking mechanisms can be used to pull the draw string 100 to the drawing configuration 130, such as disclosed in U.S. Pat. No. 7,624,725 (Choma); U.S. Pat. No. 7,204,242 (Dziekan); U.S. Pat. No. 6,913,007 (Bednar); U.S. Pat. No. 4,942,861 (Bozek); U.S. Pat. No. 6,799,566 (Malucelli); U.S. Pat. No. 6,705,304 (Pauluhn); U.S. Pat. No. 6,286,496 (Bednar); U.S. Pat. No. 6,095,128 (Bednar); and U.S. Pat. No. 4,719,897 (Gaudreau), which are hereby incorporated by reference.

Figure 16:
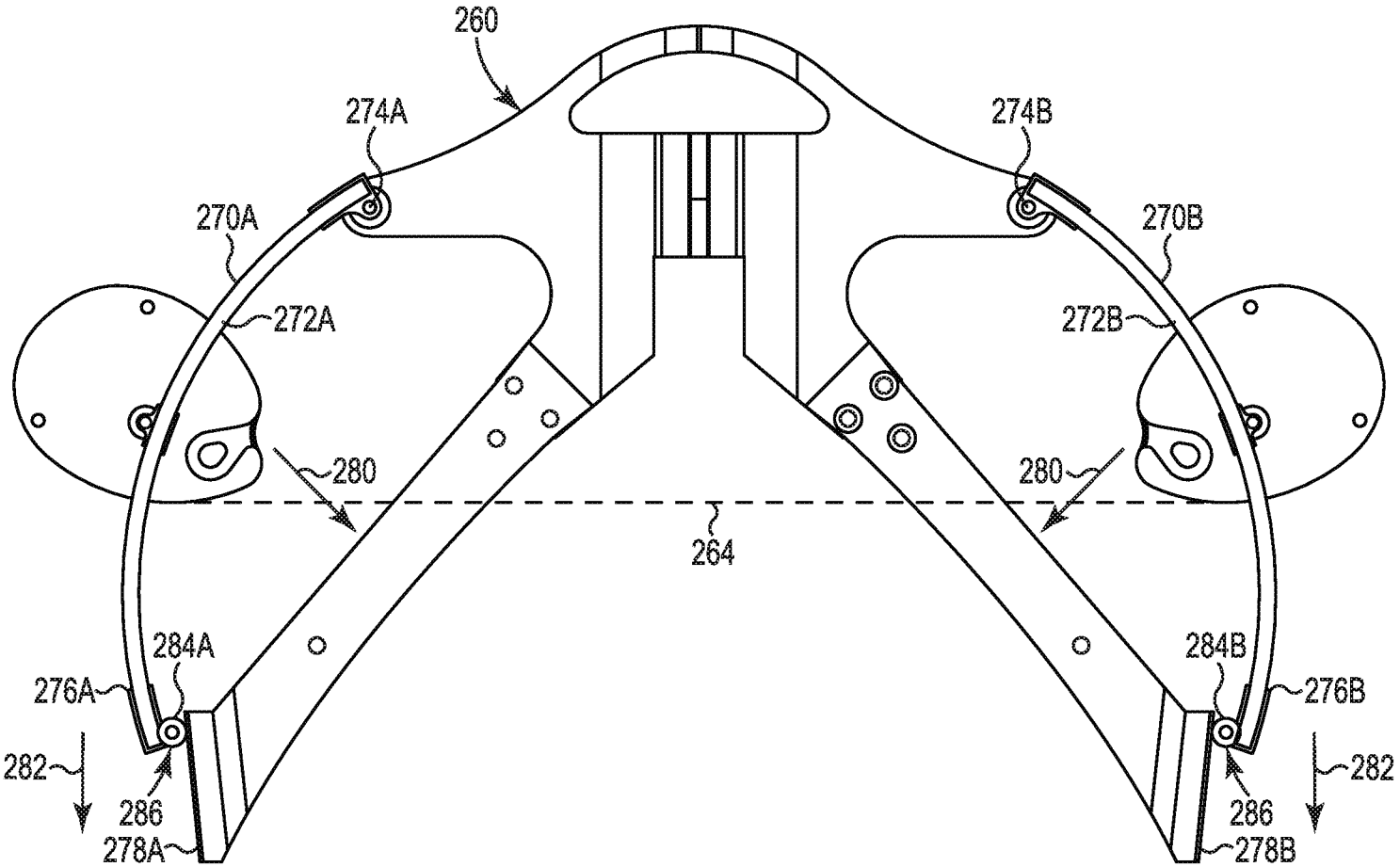
FIG. 16 is a plan view of an alternate energy storage device for an energy storage system in accordance with an embodiment of the present disclosure.

FIG. 16 illustrates an alternate energy storage device 260 with alternate limb relief in accordance with an embodiment of the present disclosure. The center support 262, the draw string 264, and the power stings 266A, 266B are removed for clarity (see FIG. 17).

Distal portions 270A, 270B ("270") of limbs 272A, 272B ("272") are attached to the device 260 at locations 274A, 274B (274"), respectively. The attachment at the locations 274 can employ various couplings (e.g., a rigid coupling, a pivoting coupling, a linkage coupling, a rotating coupling, a sliding coupling, an elastomeric coupling, or a combination thereof). Proximal portions 276A, 276B ("276") of the limbs 272 are configured to engage with portions 278A, 278B ("278") of the device 260, respectively. It is possible to reverse this configuration by locating the portions 278 at the distal end of the device 260.

When the draw string 264 is in the drawn configuration 140, the limbs 272 deform in direction 280 and the proximal portions 276 translate along portions 278 in direction 282 to provide limb relief through a sliding coupling. In one embodiment, the portions 278 have a curvilinear shape to increase let-off when the draw string 264 is in the fully drawn configuration 140.

In another embodiment, the proximal portions 276 are dynamically coupled to the portions 278 of the device 260. The proximal portions 278 are not attached to the device 260. For example, space 286 may exist between the proximal portions 276 of the limbs 272 and the portions 278 when the draw string 264 is in the released configuration 130. As the limbs 272 deformed while the draw string 264 is drawn, however, the proximal portions 276 of the limbs 272 engage with the portions 278 on the device 260 and are displaced in the direction 282 in a combination of a dynamic coupling and a sliding coupling.

In another embodiment, the proximal portions 276 are positively coupled to the portions 278 by sliding couplings 284A, 284B ("284"). One advantage of the positive couplings 284 is that when the draw string 264 is released, the proximal portions 276 are prevented from lifting off of the portions 278 on the device 260, reducing noise.

In another embodiment, the proximal portions 276 of the limbs 272 are fixedly attached to the portions 278 of the device 260 as shown. The portions 278 are constructed from, an elastomeric material configured to deform as the limbs 272 are deformed in the direction 280 to provide limb relief via an elastomeric coupling.

Any of the limb relief embodiments disclosed herein may be used alone or in combination.

Figure 17:
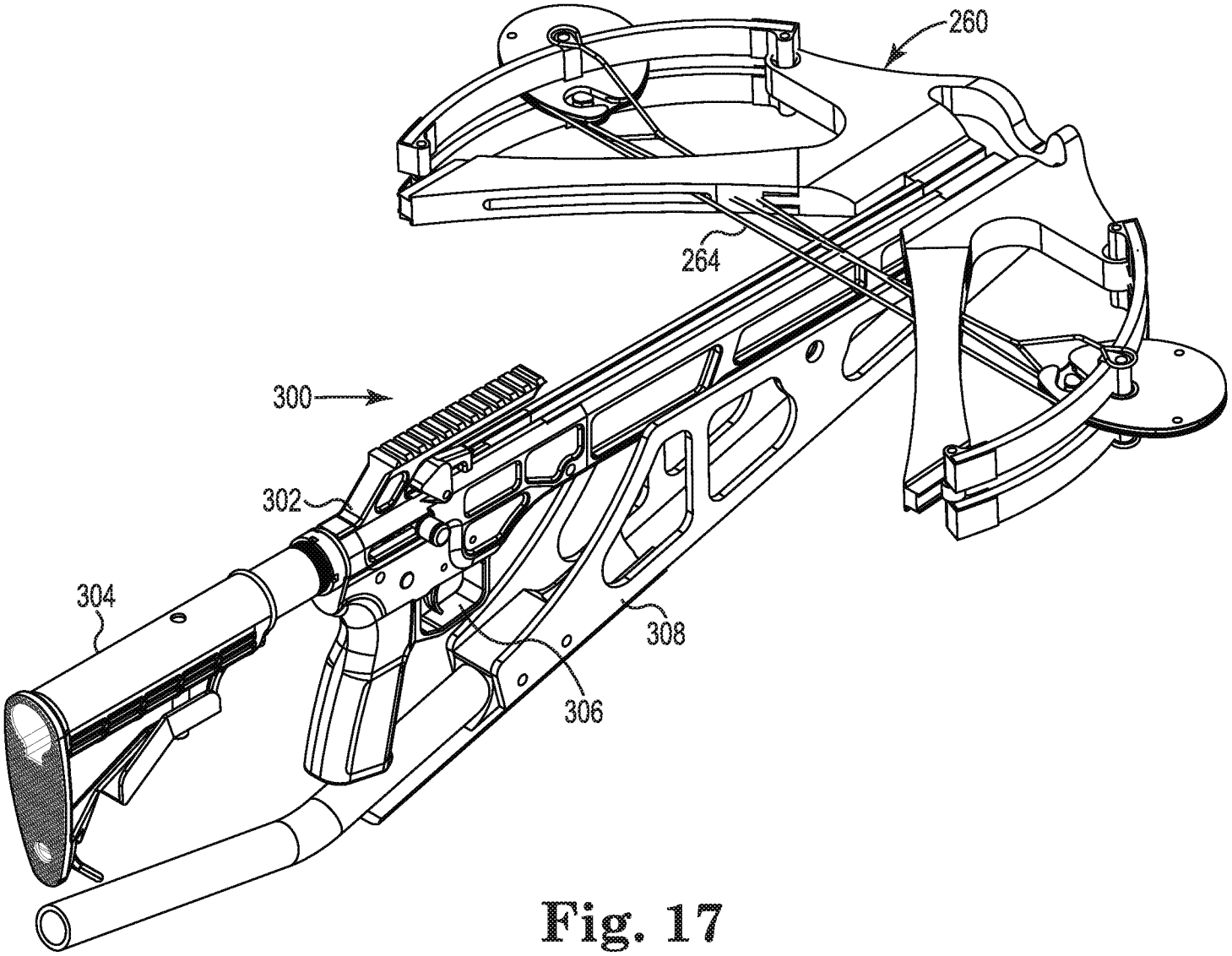
FIG. 17 is a bow with the energy storage device of FIG. 16 in accordance with an embodiment of the present disclosure.

FIG. 17 is a perspective view of bow 300 with the energy storage device 260 in accordance with an embodiment of the present disclosure. Proximal end 302 of the center support 262 includes stock 304 and trigger assembly 306 configured to releasably retain draw string 264 in the drawing configuration 140. Cocking assembly 308 is mounted at bottom of center support 262 as discussed herein.

Figure 18:
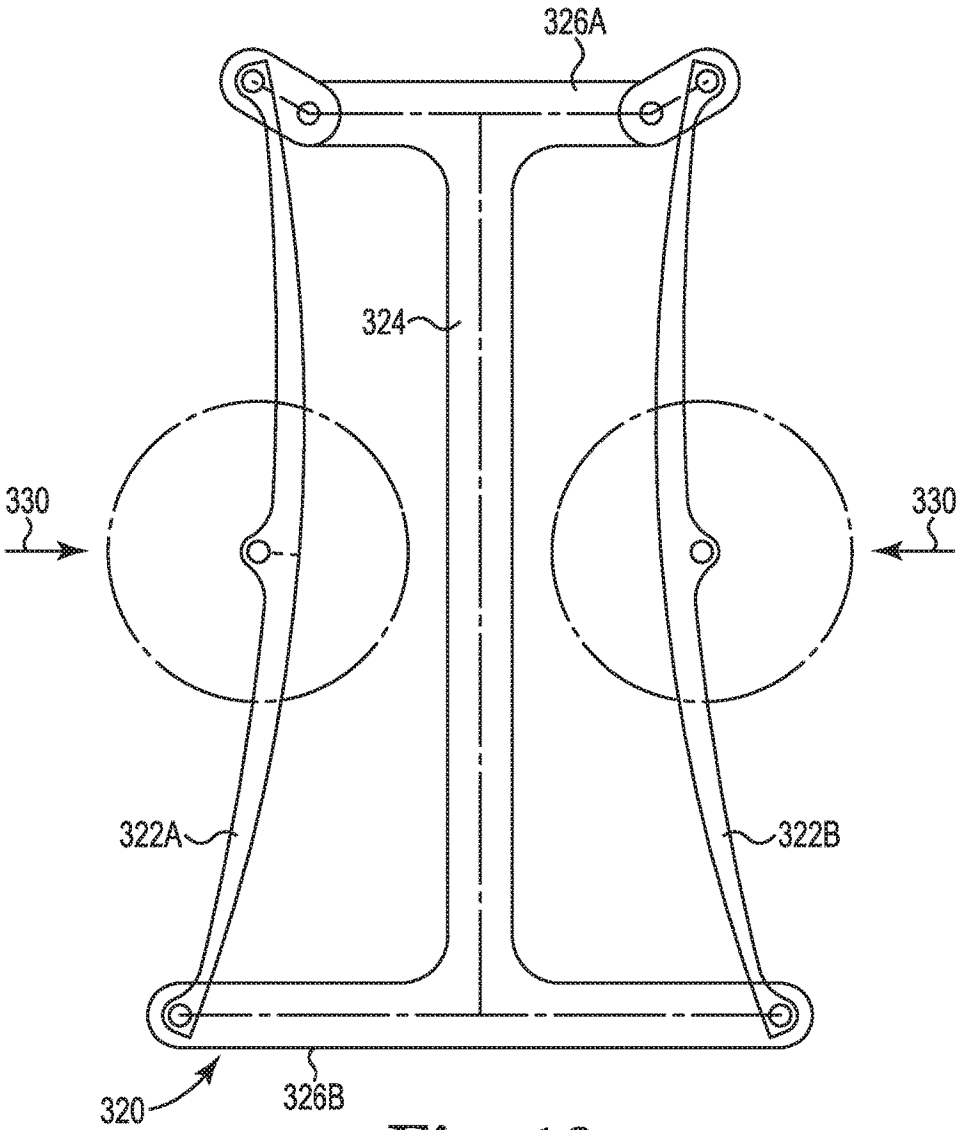
FIG. 18 illustrates an energy storage portion for a bow with convex limbs in accordance with an embodiment of the present disclosure.

FIG. 18 is a schematic illustration of an alternate energy storage device 320 with convex limbs 322A, 322B ("322") with respect to center support 324 in accordance with an embodiment of the present disclosure. The center support 324 includes distal and proximal spacers 326A, 326B ("326") that retain the limbs 322 in a spaced configuration.

The convex limbs 322 deflect inward in directions 330 toward the center support 324 as the draw string (not shown) is moved to the drawing configuration. In the illustrated embodiment, limb relief is provided by translation arms 328, although any of the limb relief mechanism disclosed herein may be used.

FIGS. 19A and 19B illustrate an alternate energy storage device 350 in which limb relief is provided by center support 352 in accordance with an embodiment of the present disclosure. Center support 352 includes a distal portion 354A and a proximal portion 354B connected by displacement mechanism 356. The displacement mechanism 356 permits the distal portion 354 to be displaced relative to the proximal portion 354B along axis 358. The displacement mechanism 356 may be an elastomeric member, a pneumatic or hydraulic cylinder, or a variety of other structures configured to bias the distal portion 354A toward the proximal portion 354B along the axis 358.

Distal ends 360A, 360B ("360") of limbs 362A, 362B ("362") are attached to the distal portion 354A of the center support 352. Proximal ends 364A, 364B ("364") of limbs 362 are attached to the proximal portion 354B of the center support 352. As the draw string (not shown) is moved to the drawing configuration 140, the limbs 362 flatten so that distance 366 between distal ends 360 and, proximal ends 364 of the limbs 362 increases to provide limb relief As the draw string is released, the displacement mechanism 356 biases the distal portion 354A toward the proximal portion 354B to the configuration shown in FIG. 19A.

Figure 20A:
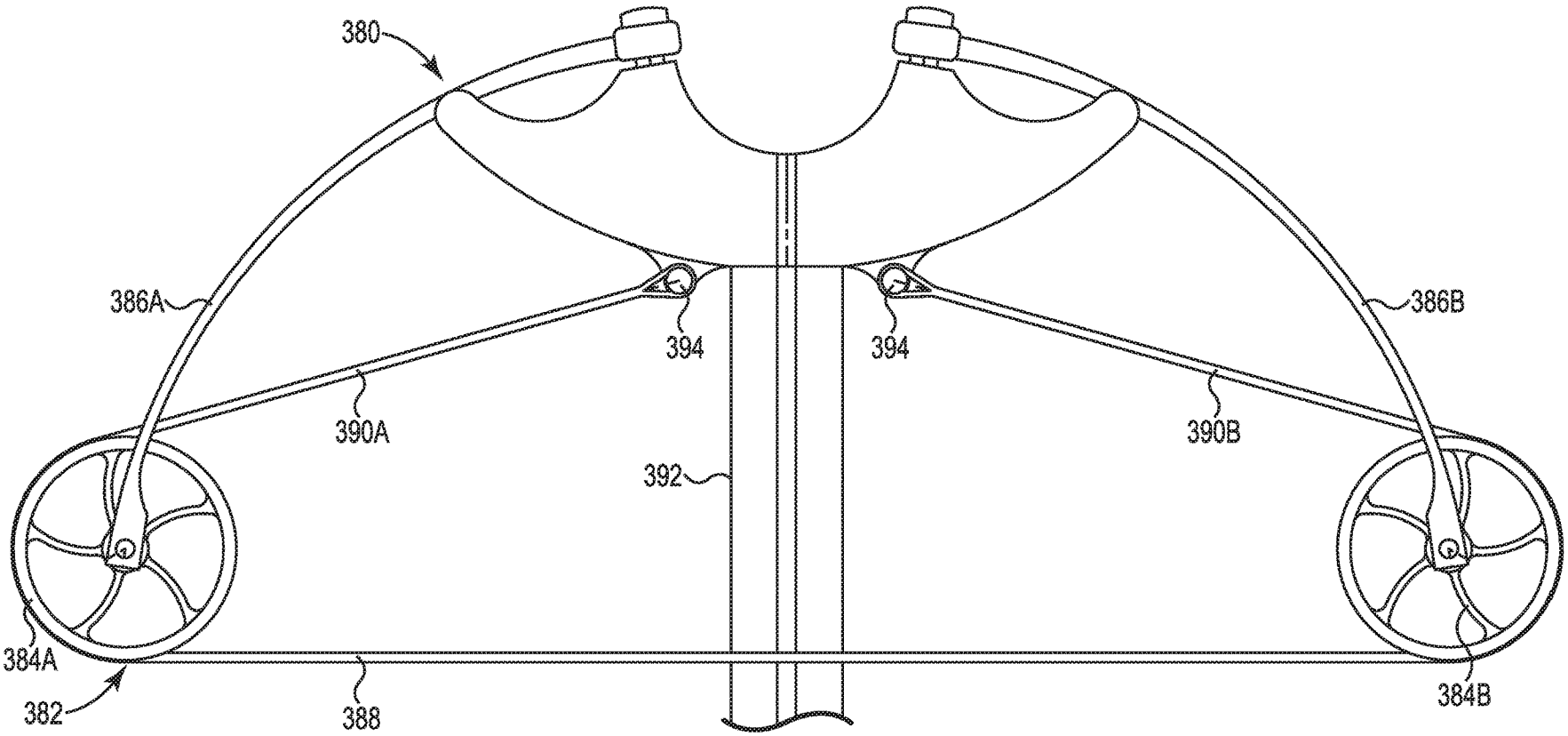
FIGS. 20A and 20B illustrate a conventional energy storage portion of a conventional bow with a pulley system in accordance with an embodiment of the present disclosure.
Figure 20B:
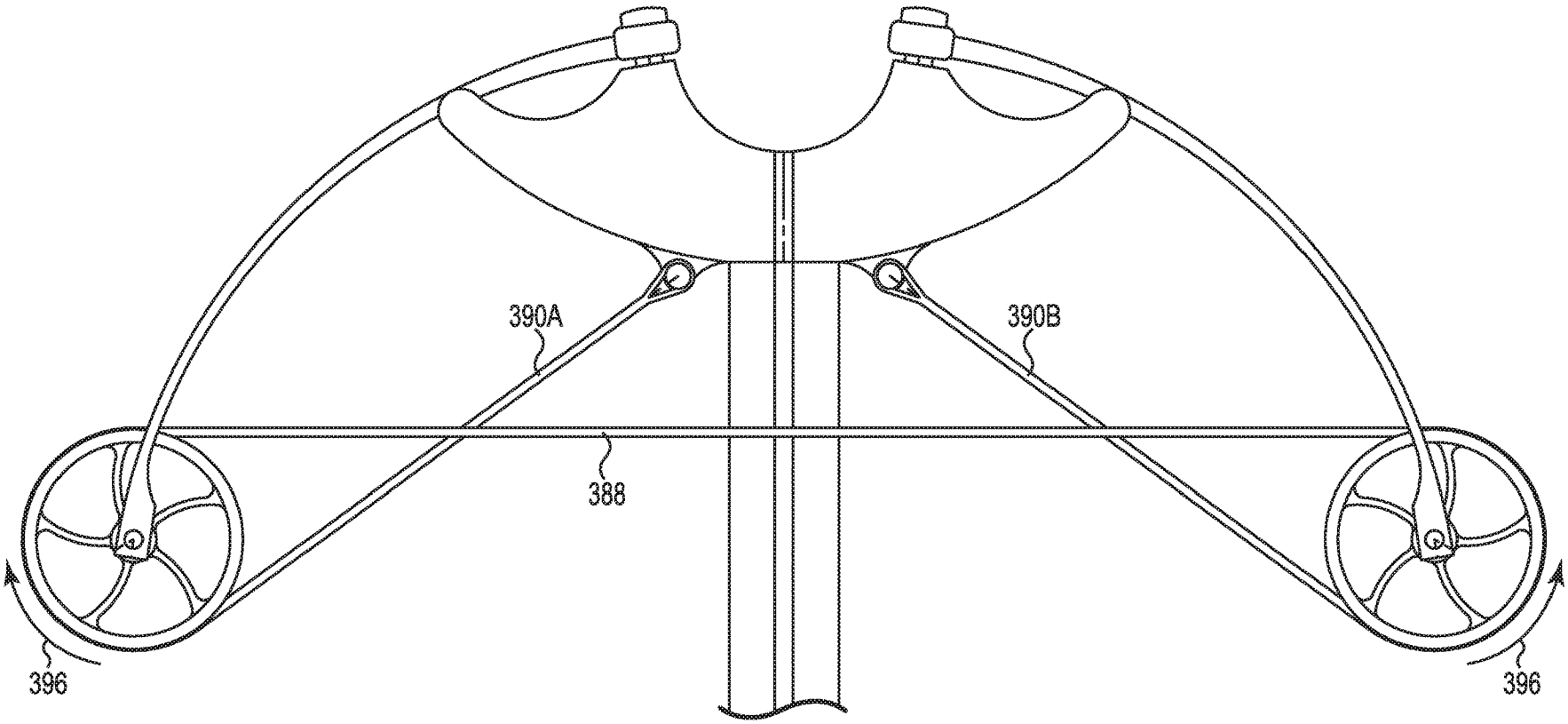

FIGS. 20A and 20B are top views of an energy storage portion 380 of a conventional bow with a pulley system 382 in accordance with an embodiment of the present disclosure. The pulley system 382 includes pulleys 384A, 384B ("384") attached to ends of limbs 386A, 386B ("386"). Draw string 388 and power strings 390A, 390B ("390") wrap around the pulleys 384 and attach to the center support 392. The power strings 390 do not cross-over the center support 388. Consequently, only the draw string 384 crosses over the center support 388.

In the illustrated embodiment, the power strings 390 and the draw string 388 are a single structure with ends 394 attached to the center support 392. In an alternate embodiment, the power strings 390 and the draw strings 388 can be discrete structures, such as illustrated in FIG. 3. The embodiment of FIG. 20B reverses the wrap of the power strings 390 and draw string 388 around the pulleys 384 in directions 396 to increase the draw length.

Figure 21C:
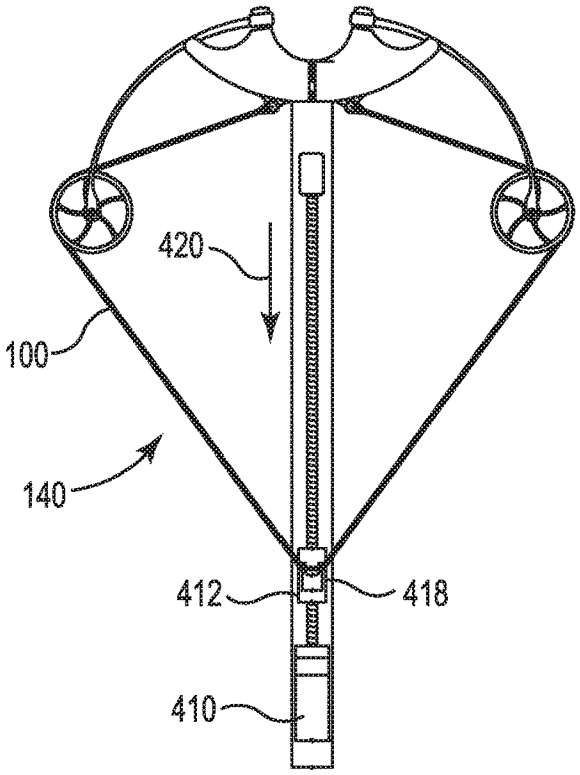
FIGS. 21A-21C illustrate an alternate cocking mechanism for a bow in accordance with an embodiment of the present disclosure.
Figure 21B:
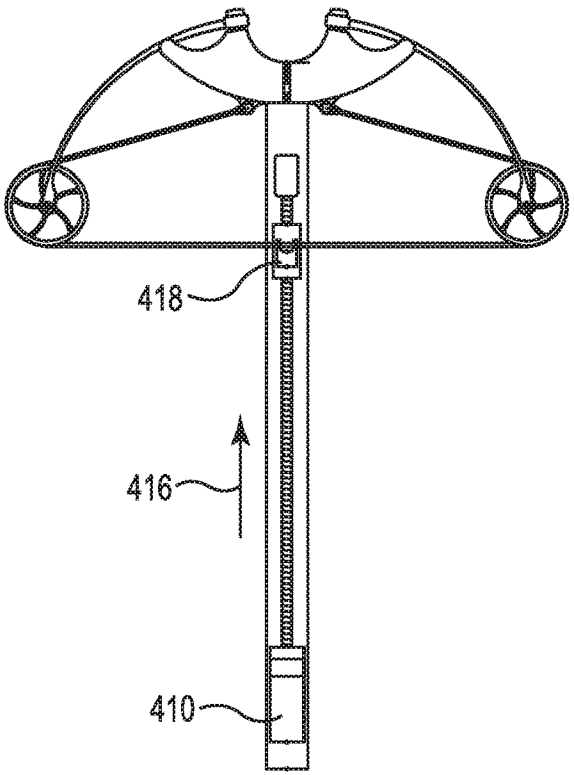
Figure 21A:
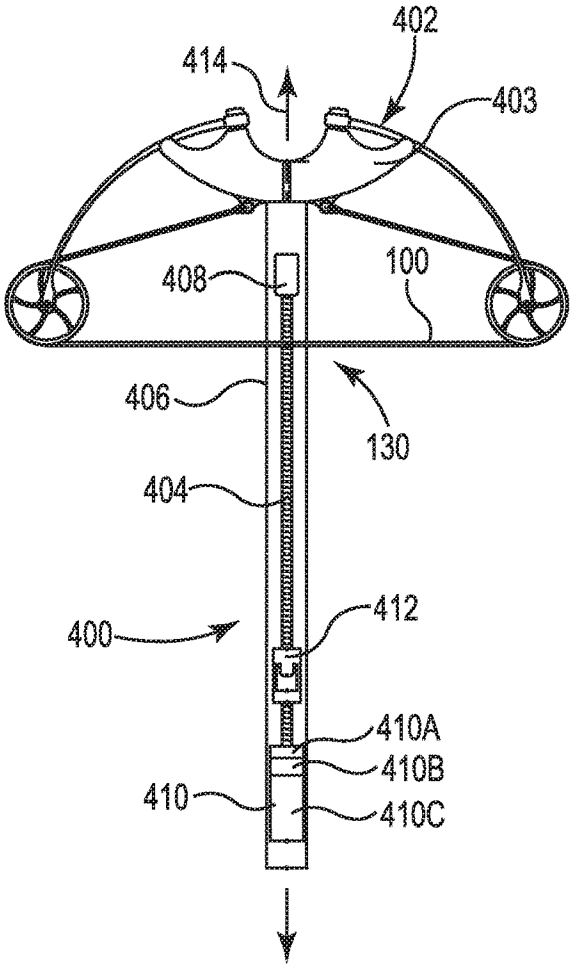

FIGS. 21A-21C illustrate an alternate cocking mechanism 400 for a bow 402 in accordance with an embodiment of the present disclosure. The present cocking mechanism 400 can be used with any of the bows disclosed herein. The cocking mechanism is preferably located in a recess in the center support 406 (see e.g., FIG. 22) for optimum weight distribution.

Threaded shaft 404 is mounted in or on center support 406 between distal pivot assembly 408 and proximal pivot assembly 410 behind or proximal of the energy storage assembly 403 of the bow 402. The threaded shaft 404 can be a ball screw, lead screw, power screw, translation screw, or the like. The threaded shaft 404 can be constructed from a variety of materials, such as light weight metals like aluminum or polymeric materials such as nylon or high density polyethylene. The threaded shaft 404 can have a thread pitch in the range of about 0.25 inches to about 2.0 inches.

Traveler 412 traverses axis 414 as the threaded shaft 404 is rotated. Rotation of the threaded shaft 404 can be effectuated from either the distal or proximal pivot assemblies 408, 410. In the illustrated embodiment, the proximal pivot assembly 410 includes a mechanism for rotating the threaded shaft 404, such as a rotary crank, a lever, or an electromagnetic device, such as a motor. In one embodiment, the proximal pivot assembly 410 includes pivot bearing 410A, a motor 410B, and a battery 410C. The motor 410B and/or battery 410C can either be part of the proximal pivot assembly 410 or separate component.

In one another embodiment, the motor 410B and battery 4100 releasably engages with the proximal pivot assembly 410 to operate the threaded shaft 404. When not required, the motor and battery are removed from the bow 402 to reduce weight. In another embodiment, the user carries the battery 410C separate from the bow 402. The battery 410C can be plugged into the proximal pivot assembly 410 to power the motor 410B as needed.

FIG. 21A illustrates the draw string 100 in the release configuration 130. In operation the threaded shaft 404 is rotated to advance the traveler 412 in direction 416 until drawstring catch 418 engages the draw string 100, as, illustrated in FIG. 21B. The drawstring catch 418 preferably slides in a slot formed in the center support 406 (see e.g., FIG. 12A).

Rotation of the threaded shaft 404 is then reversed to move the traveler 412 in the opposite direction 420 until the draw string 100 is in the drawn configuration 140, as illustrated in FIG. 21C. This process can also be reverse to un-draw the draw string 100 from the drawn configuration 140 to the released configuration 130.

In one embodiment, the traveler 412 brings the draw string 100 into engagement with a trigger assembly (see e.g., FIG. 17). The drawstring catch 418 then releases the draw string 100, which is held in place by the trigger assembly. In another embodiment, the drawstring catch 418 operates as the trigger assembly. Alternate cocking mechanisms for a bow are shown in U.S. Pat. No. 7,784,453 (Yehle); U.S. Pat. No. 6,913,007 (Bednar); U.S. Pat. No. 6,799,566 (Malucelli); and U.S. Pat. No. 5,220,906 (Choma), which are hereby incorporated by reference.

In one embodiment, a brake system is provided to control rotation of the threaded shaft 404, such as a friction brake or an eddy current brake. The brake system prevents the traveler 412 from being moved in the direction 416 by the force of the draw string 100.

In another embodiment, a ratcheting system or one-way bearing is used to control movement of the traveler 412 along the length of the center support 406. (see e.g., FIGS. 14 and 15). For example, if the battery lacks sufficient power to move the traveler 412 to the fully drawing configuration, the ratcheting system or one-way bearing prevents the draw string 100 from rapidly returning to the released configuration 130.

Figure 22:
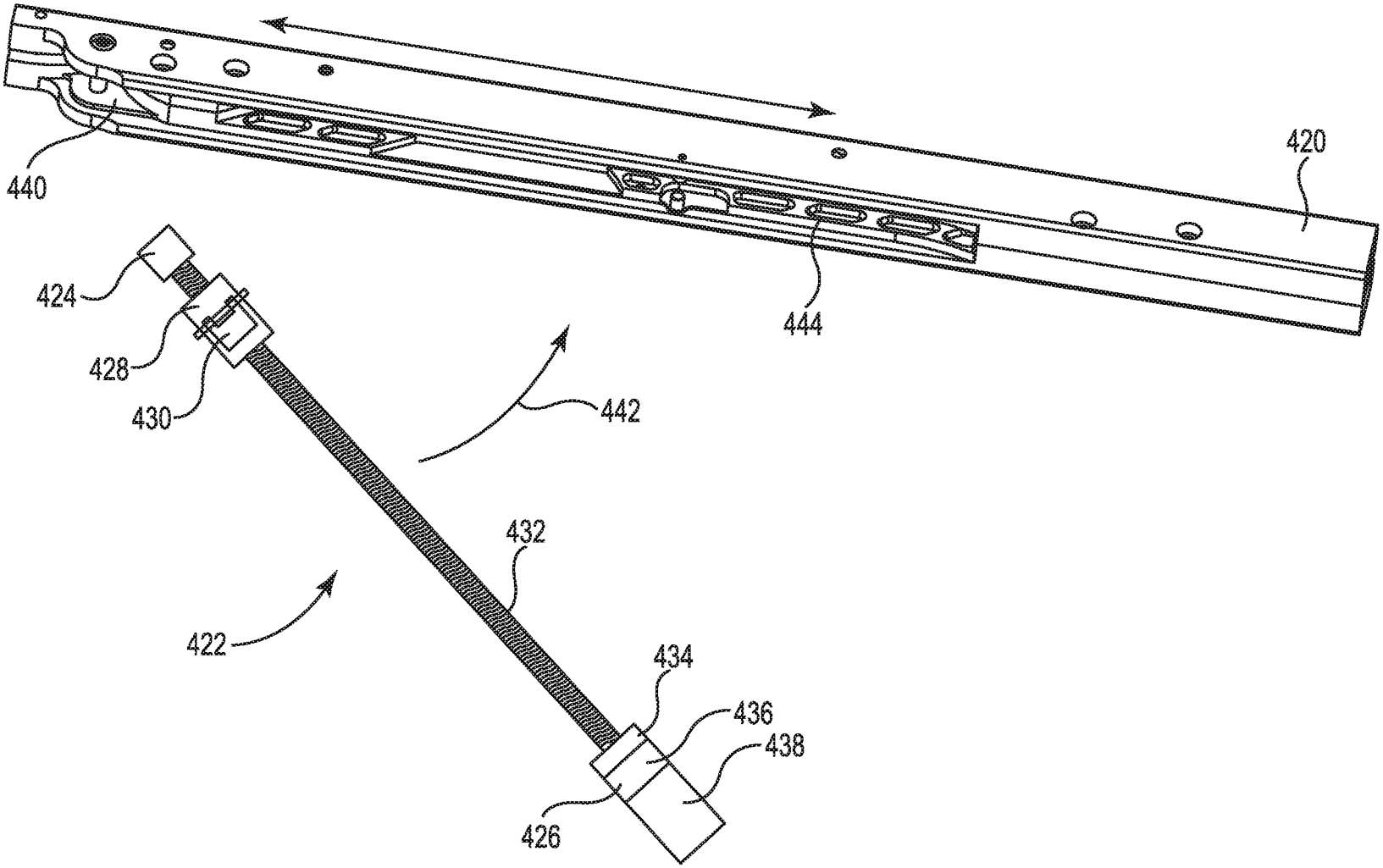
FIG. 22 is a perspective view of a removable cocking mechanism for a bow in accordance with an embodiment of the present disclosure.

FIG. 22 is a perspective view of a center support 420 for a bow (see e.g., FIG. 21A) with a removable cocking mechanism 422 in accordance with an embodiment of the present disclosure. The cocking mechanism 422 includes a distal pivot assembly 424, a proximal pivot assembly 426, and a traveler 428 with a drawstring catch 430 that travels on threaded shaft 432, as discussed above. The proximal pivot assembly 426 includes a pivot bearing 434, a motor 436, and a battery 438.

In one embodiment, the distal pivot assembly 424 is inserted in proximal end 440 of the center support 420. The cocking, mechanism 422 is then rotated in direction 442 into engagement with opening 444 in the center support 420. After the drawstring 100 is moved to the drawing configuration 140 (see FIG. 21C), the cocking mechanism 422 can be removed. In another embodiment, the proximal pivot assembly 426 is inserted into the center support 420 first.

FIGS. 23A-23F illustrate an alternate cocking mechanism 450 for a bow 452 in accordance with an embodiment of the present disclosure. The present cocking mechanism 450 can be used with any of the bows disclosed herein. The cocking mechanism is preferably located in a recess in the center support 456 (see e.g., FIG. 22) for optimum weight distribution.

Belt 454 is mounted in or on center support 456 between distal pulley assembly 458 with pulley 458A and proximal pulley assembly 460 with pulley 460A behind or proximal of the energy storage assembly 453 of the bow 452. The belt 454 can be a tooth or smooth belt, a chain, or the like. The belt 454 can be constructed from a variety of materials, such as light weight metals like aluminum or polymeric materials such as nylon or high density polyethylene. The teeth on the belt 454 can have a pitch in the range of about 0.25 inches to about 2.0 inches. In one embodiment, the drive pulley 458A. 460A includes corresponding teeth.

Traveler 462 traverses axis 464 as the belt 454 is rotated around the pulleys 458A, 460A. Rotation of the belt 454 can be effectuated from either the distal or proximal pulley 458A, 460A. In the illustrated embodiment, the proximal pulley assembly 460 includes a mechanism for rotating the pulley 460A, such as a rotary crank, a lever, or an electromagnetic device, such as a motor. In one embodiment, the proximal pulley assembly 460 includes a motor 460B and a battery 460C. The motor 460B and/or battery 460C can either be part of the proximal pulley assembly 460 or separate component.

In one another embodiment, the motor 460B and battery 460C releasably engages with the proximal pulley assembly 460 to operate the pulley 460A. When not required, the motor and battery are removed from the bow 452 to reduce weight. In another embodiment, the user carries the battery 460C separate from the bow 452. The battery 460C can be plugged into the proximal pivot assembly 460 to power the motor 460B as needed.

Figure 23C:
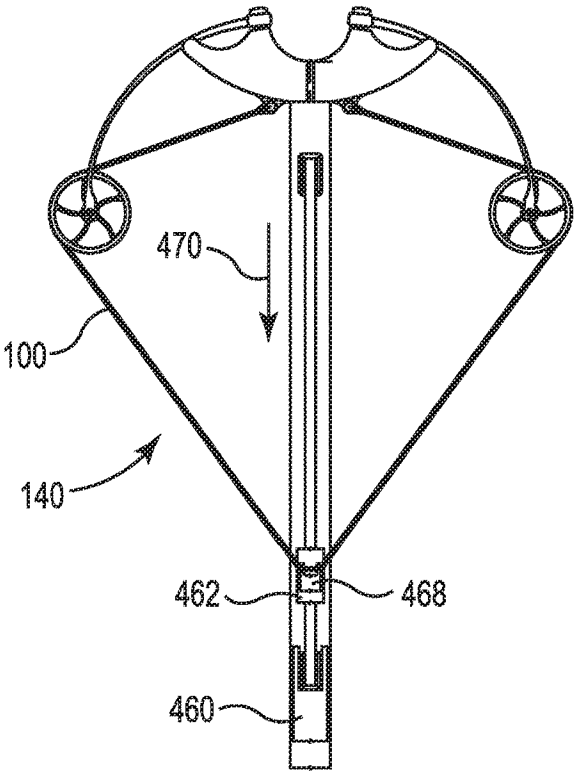
FIGS. 23A-23C illustrate a belt-driven cocking mechanism for a bow in accordance with an embodiment of the present disclosure.
Figure 23B:
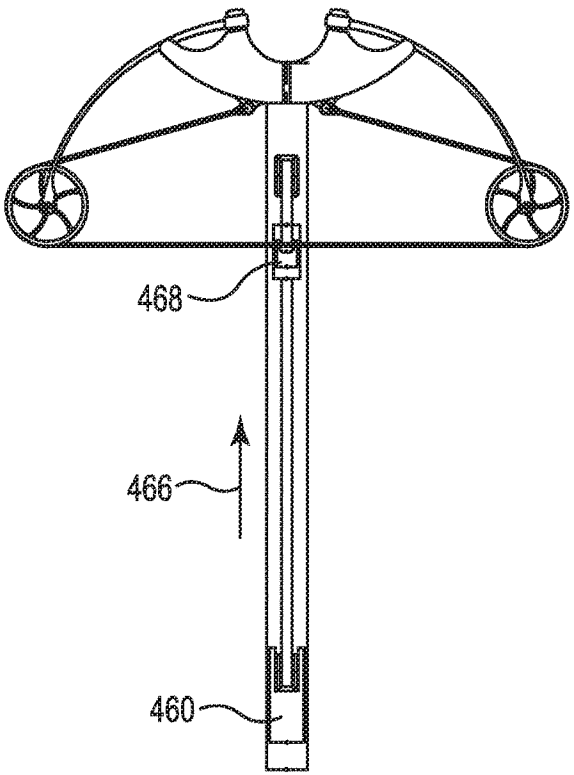
Figure 23A:
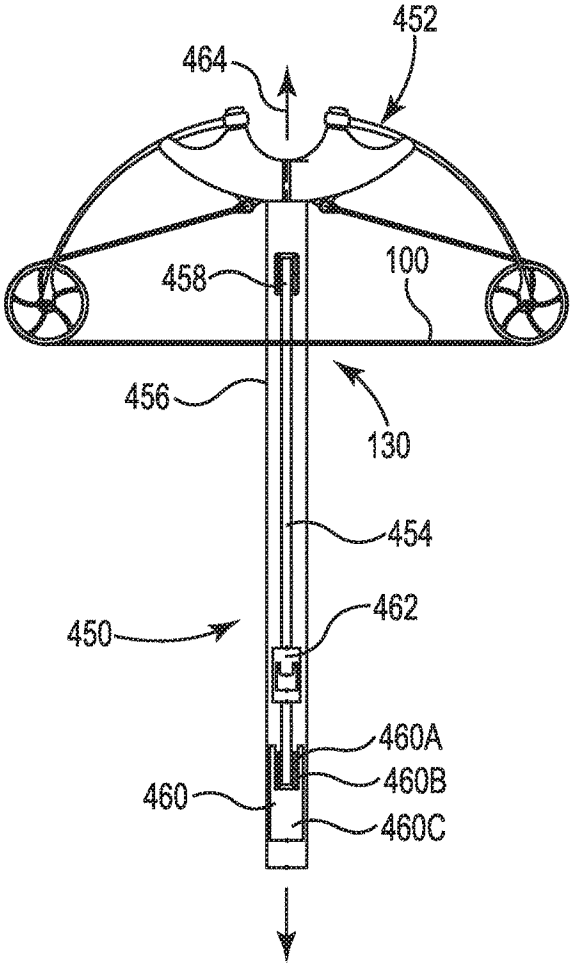
Figure 23E:
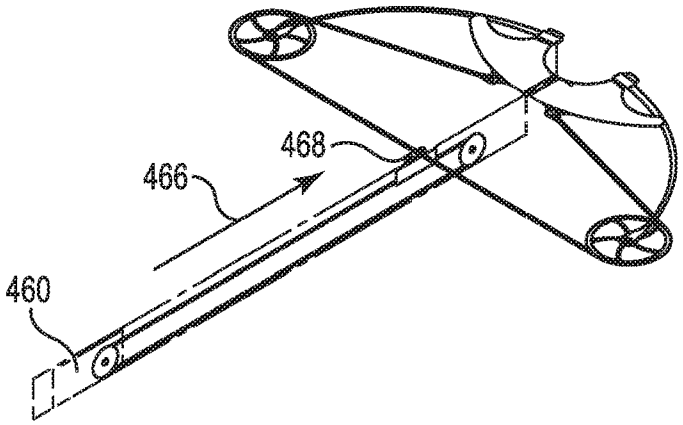
FIGS. 23D-23F are perspective views of the belt-driven cocking mechanism of FIGS. 23A-23C, respectively.
Figure 23F:
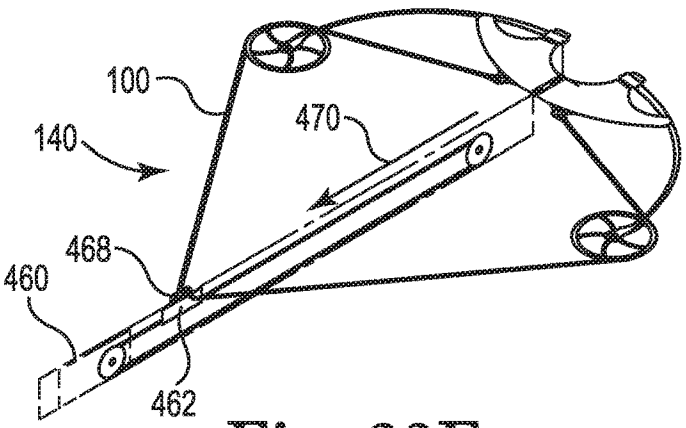
Figure 23D:
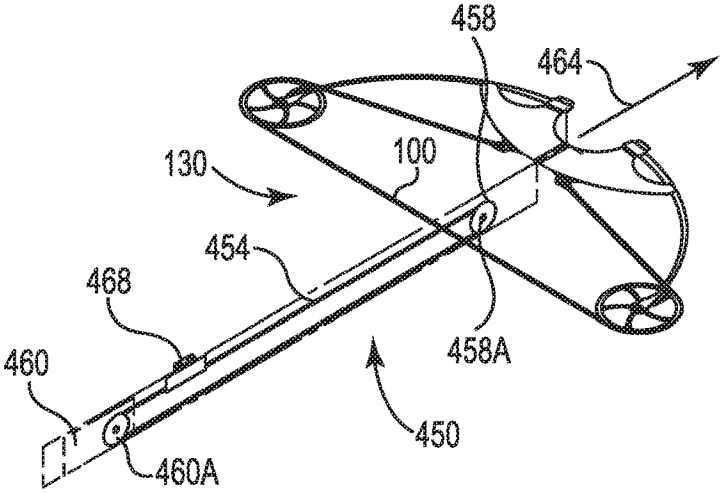

FIGS. 23A and 23D illustrate the draw string 100 in the release configuration 130. In operation, the pulleys 458A, 460A rotate to move the belt 454 and advance the traveler 462 in direction 466 until drawstring catch 468 engages the draw string 100, as illustrated in FIGS. 23B and 23E. The drawstring catch 468 preferably slides in a slot formed in the center support 456 (see e.g., FIG. 12A).

Rotation of the belt 454 around the pulleys 458A, 460A is then reversed to move the traveler 462 in the opposite direction 470 until the draw string 100 is in the drawn configuration 140, as illustrated in FIGS. 23C and 23F. This process can also be reverse to un-draw the draw string 100 from the drawn configuration 140 to the released configuration 130.

In one embodiment, the traveler 462 brings the draw string 100 into engagement with a trigger assembly (see e.g., FIG. 17). The drawstring catch 468 then releases the draw string 100, which is held in place by the trigger assembly. In another embodiment, the drawstring catch 468 operates as the trigger assembly.

In one embodiment, a brake system is provided to control rotation of the belt 454, such as a friction brake or an eddy current brake. The brake system prevents the traveler 462 from being moved in the direction 466 by the force of the draw string 100.

In another embodiment, a ratcheting system or one-way bearing is used to control movement of the traveler 462 along the length of the center support 456. (See e.g., FIGS. 14 and 15). For example, if the battery lacks sufficient power to move the traveler 462 to the fully drawing configuration, the ratcheting system or one-way bearing prevents the draw string 100 from rapidly returning to the released configuration 130.

Figure 24:
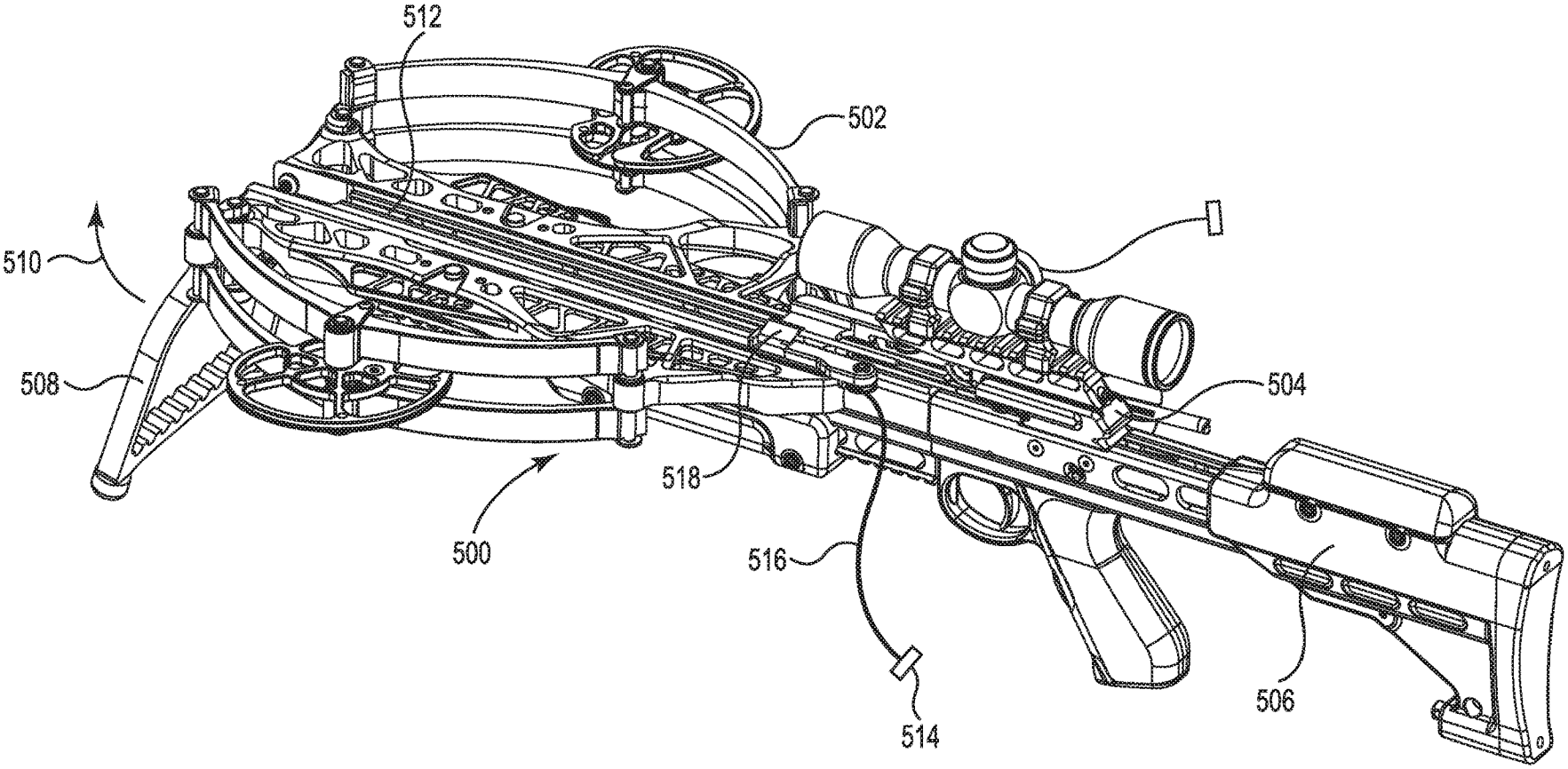
FIG. 24 is a perspective view of an alternate bow with a combined cocking and de-cocking mechanism in accordance with an embodiment of the present disclosure.
Figure 25:
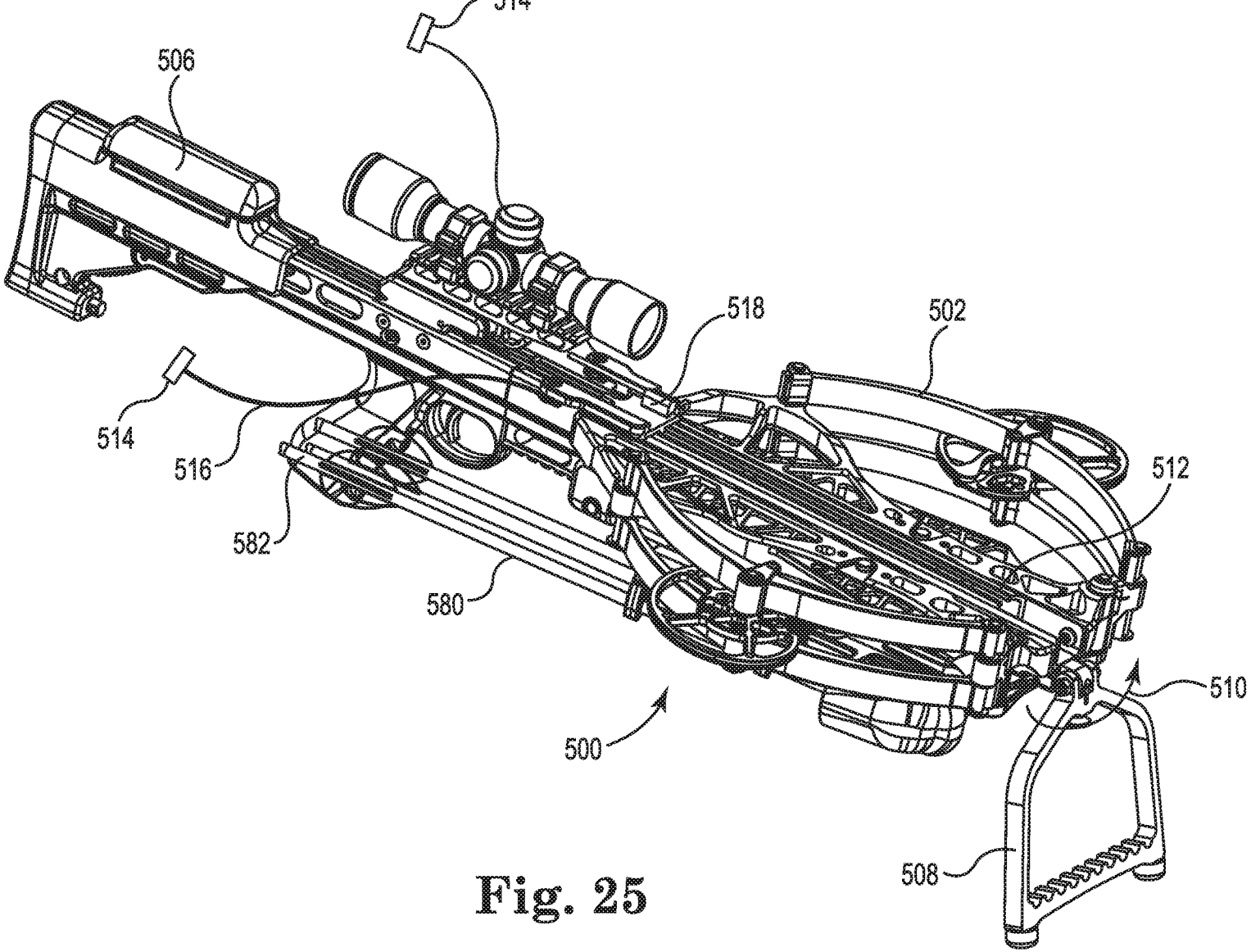
FIG. 25 is a perspective view of the bow of FIG. 24.

FIGS. 24 and 25 are perspective views of an alternate bow 500 with an energy storage device 502 in accordance with an embodiment of the present disclosure. Trigger assembly 504 with collapsible stock 506 is attached to the energy storage device 502 by center support 512. Stirrup 508 is attached at front end to secure the bow 500 to assist in the cocking procedure.

In operation, the stirrup 508 is rotated in direction 510 until it is parallel to center support 512. The user places a foot in the stirrup 508 and pulls handles 514 on the cord 516. As will be discussed below, traveler 518 moves the draw string 520 (see FIGS. 26A and 26B) into engagement with the trigger assembly 504 (see FIGS. 27 and 30). After cocking the bow 500 the stirrup 508 can be folded back to the illustrated position to serve as a bi-pod for firing the bow 500.

In an alternate embodiment, one of the cocking mechanisms 200, 400, 422, 450 disclosed herein can be used to move the traveler 518 back and forth along the center support 512 between the released configuration 130 and the drawn configuration 540. The traveler 518 is preferably releasably engaged with one of the travelers 212, 412, 428, 462 on, the corresponding cocking, mechanisms 200, 400, 422, 450 until the draw string is positioned as desired configuration.

Figure 26A:
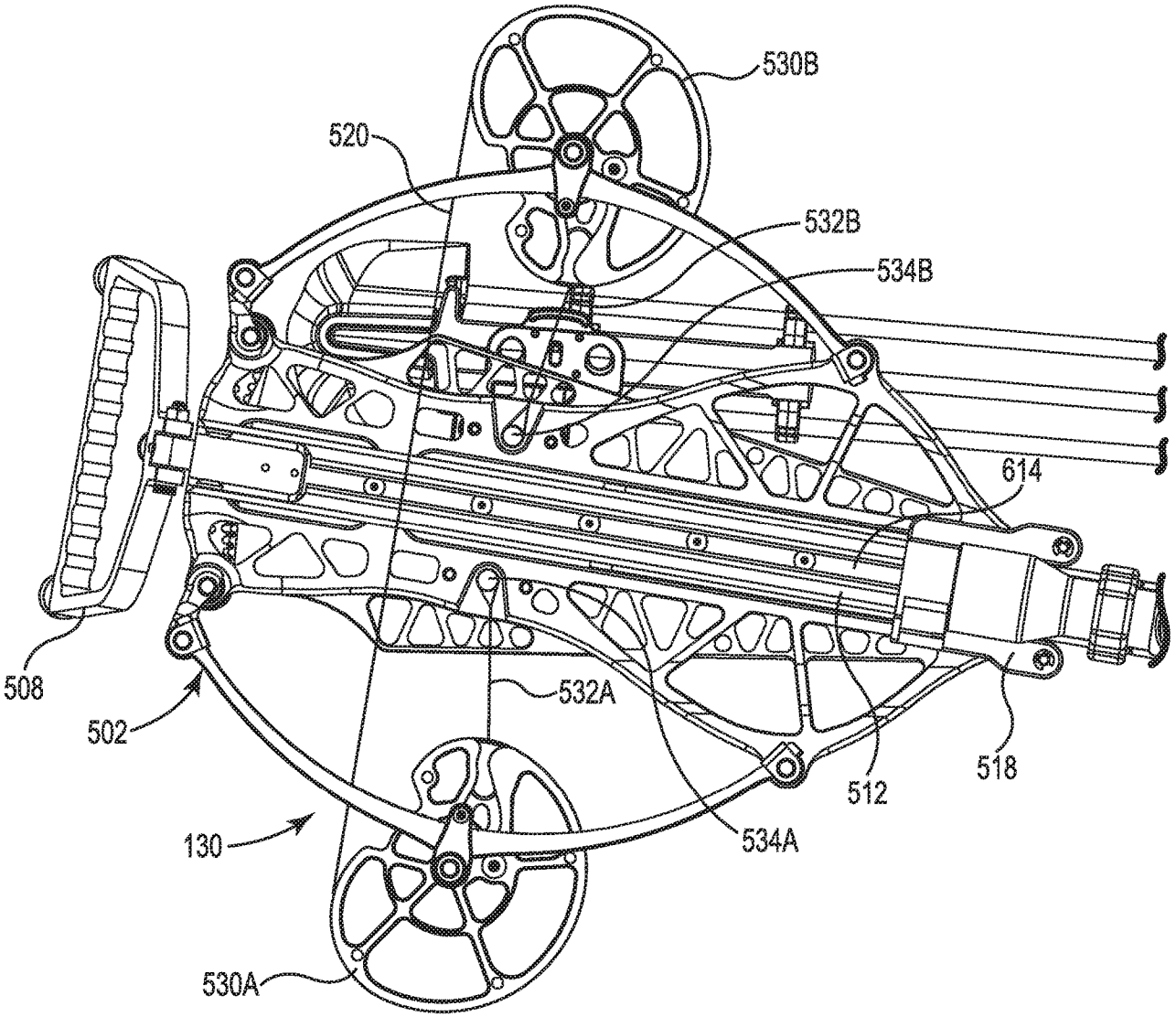
FIG. 26A is a top view of an energy storage portion of the bow of FIG. 24.
Figure 26B:
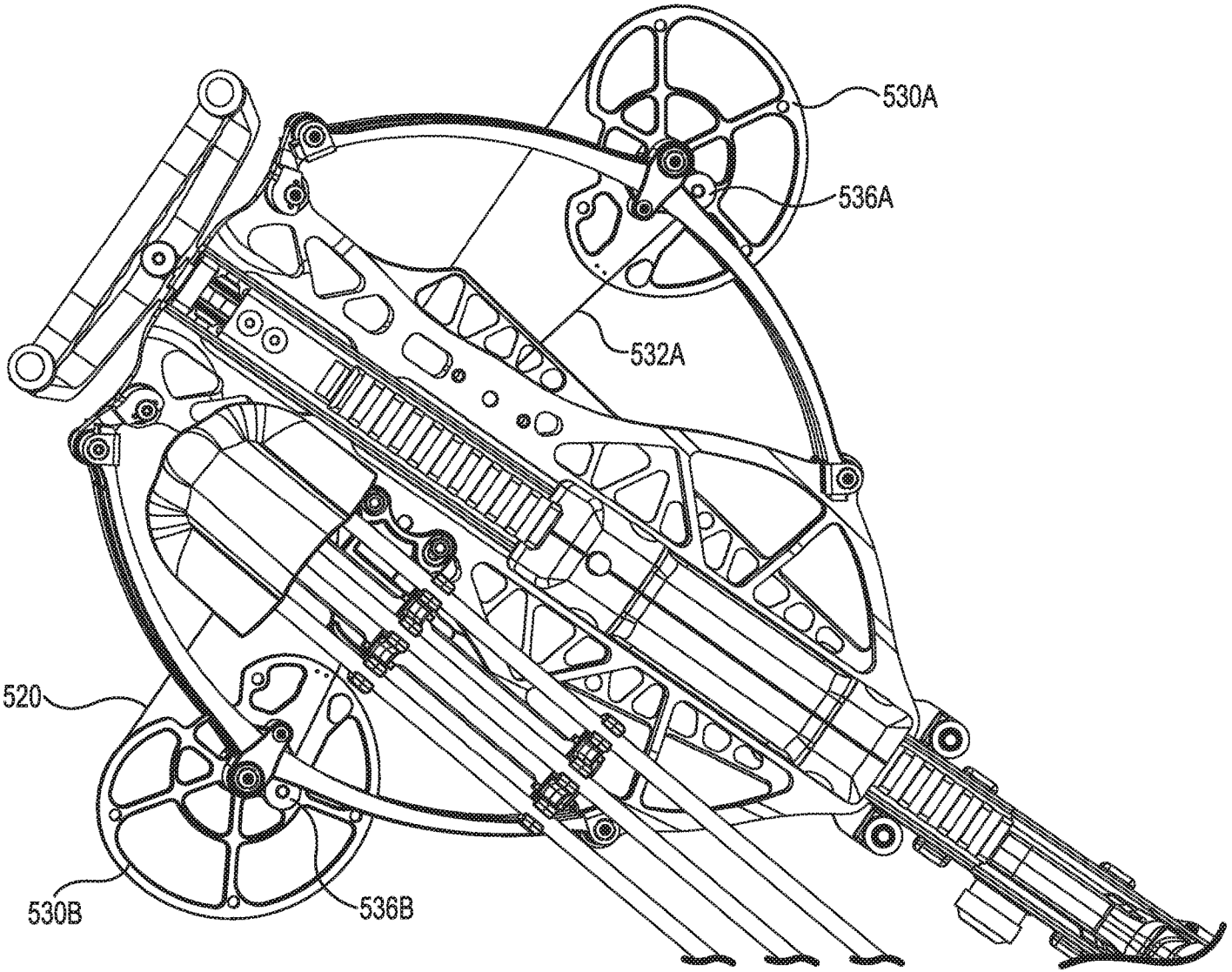
FIG. 26B is a bottom view of an energy storage portion of the bow of FIG. 24.

FIGS. 26A and 26B are top and bottom views of the energy storage device 502. Draw string 520 extends between pulleys 530A, 530B ("530"). In the illustrated embodiment, the draw string 520 is in the released configuration 130. Power strings 532A, 532B ("532") extend outward from attachment points 534A, 534B ("534") on center support 512 to attachment points 536A, 536B ("536") on the bottom of the pulleys 530A, 530B, respectively. The power strings 532 do not cross over the center support 512. In the illustrated embodiment, the no timing belt is provided between the translation arms 538A, 538B. Elimination of the timing belt is particularly effected when used with round or generally round pulleys 530.

Figure 27:
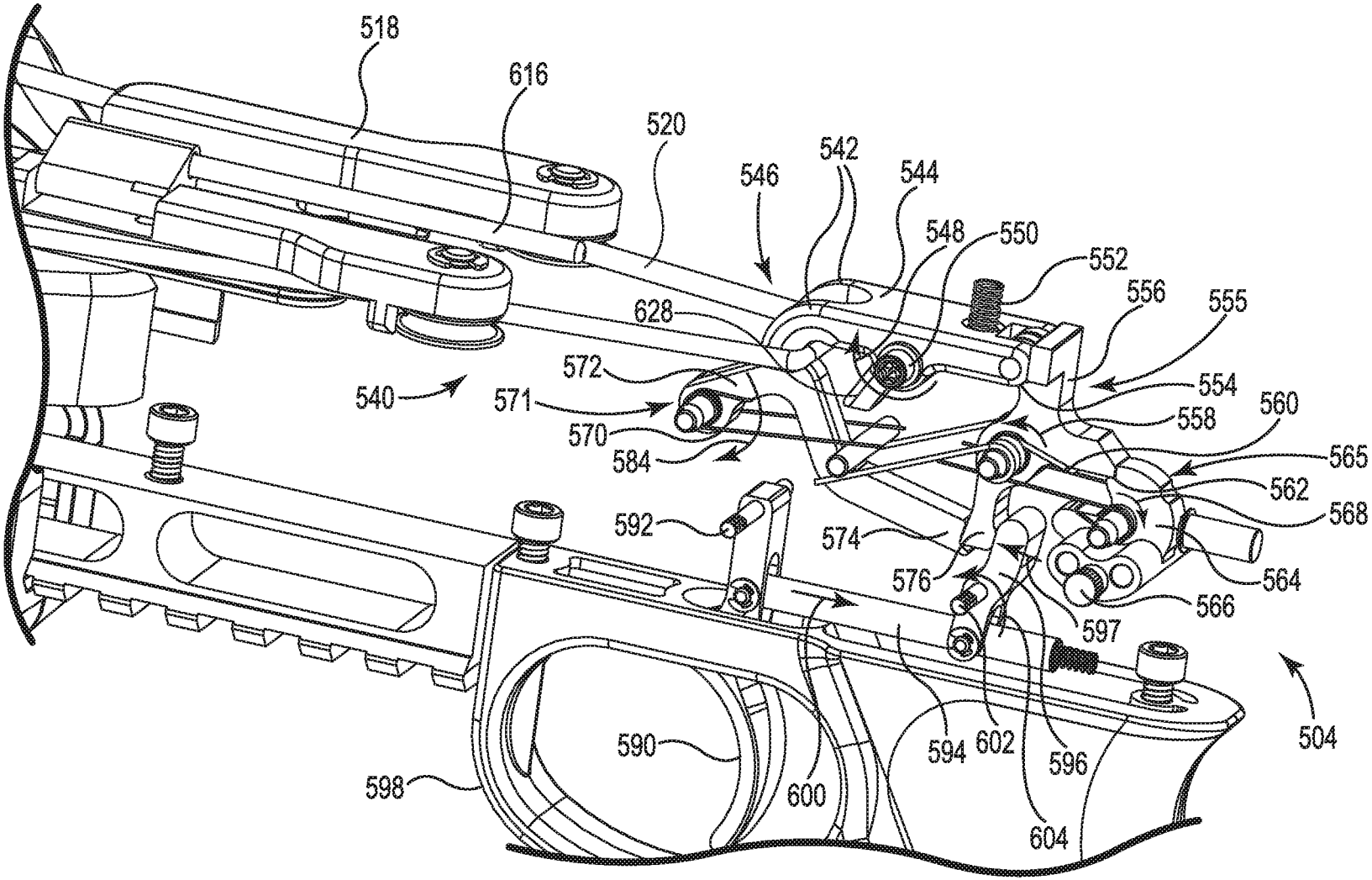
FIG. 27 is a perspective view of a trigger assembly with a draw string in a drawn configuration in accordance with an embodiment of the present disclosure.

FIG. 27 is a perspective view of the trigger assembly 504 with the housing removed. Draw string 520 is retained in the drawn configuration 540 by a pair of fingers 542 on catch 544 in closed position 546. The catch 544 is biased to rotate in direction 548 around pin 550 by spring 552. Absent an external force, the catch 544 automatically releases the draw string 520.

In cocked position 555, shoulder 554 on sear 556 provides the external force to retain the catch 544 in the closed position 546. The sear 556 is biased in direction 558 by spring 560 to retain the catch 544 in the closed position 546.

Shoulder 562 on safety 564 retains the sear 556 in the cocked position 555 and the catch 544 in the closed position 546. Safety button 566 is used to rotate the safety 564 in direction 568 from safe position 565 to free position 567 with the shoulder 562 disengaged from the sear 556 (see FIG. 28).

Spring 570 biases dry fire lockout 572 toward the intersection of the draw string 520 with the catch 544. Distal end 574 of the dry fire lockout 572 engages arm 576 on the sear 556 in a lockout position 571 to prevent the sear 556 from releasing the catch 544. Even if the safety 564 is disengaged from the sear 556, the distal end 574 of the dry fire lockout 572 locks the sear 556 in the cocked position 555 to prevent the catch 544 from releasing the draw string 520.

In use, nock 582 on a bolt 580, such as those illustrated in FIG. 25, is positioned on the center support 512 and engages the draw string 520 between the fingers 542 of the catch 544. The nock 582 also displaces the dry fire lockout 572 in direction 584 so that the distal end 574 releases the arm 576 on the sear 556 in a disengaged position 573 (See FIG. 28). Only when a bolt 580 is fully engaged with the draw string 520 will the dry fire lockout 572 permit the sear 542 to move to the fire position 569.

Trigger 590 pivots around, pin 592. Trigger linkage 594 pivotally connects the trigger 590 with trigger pawl 596. Depressing the trigger 590 in the trigger guard 598 causes the trigger linkage 594 to be displaced in direction 600, which results in the trigger pawl 596 rotating around pin 602 in direction 604. The pawl 596 provides external force 597 that moves the sear 556 from the cocked position 555 to fire position 569 shown in FIG. 28 in order to fire the bow 500.

Figure 29A:
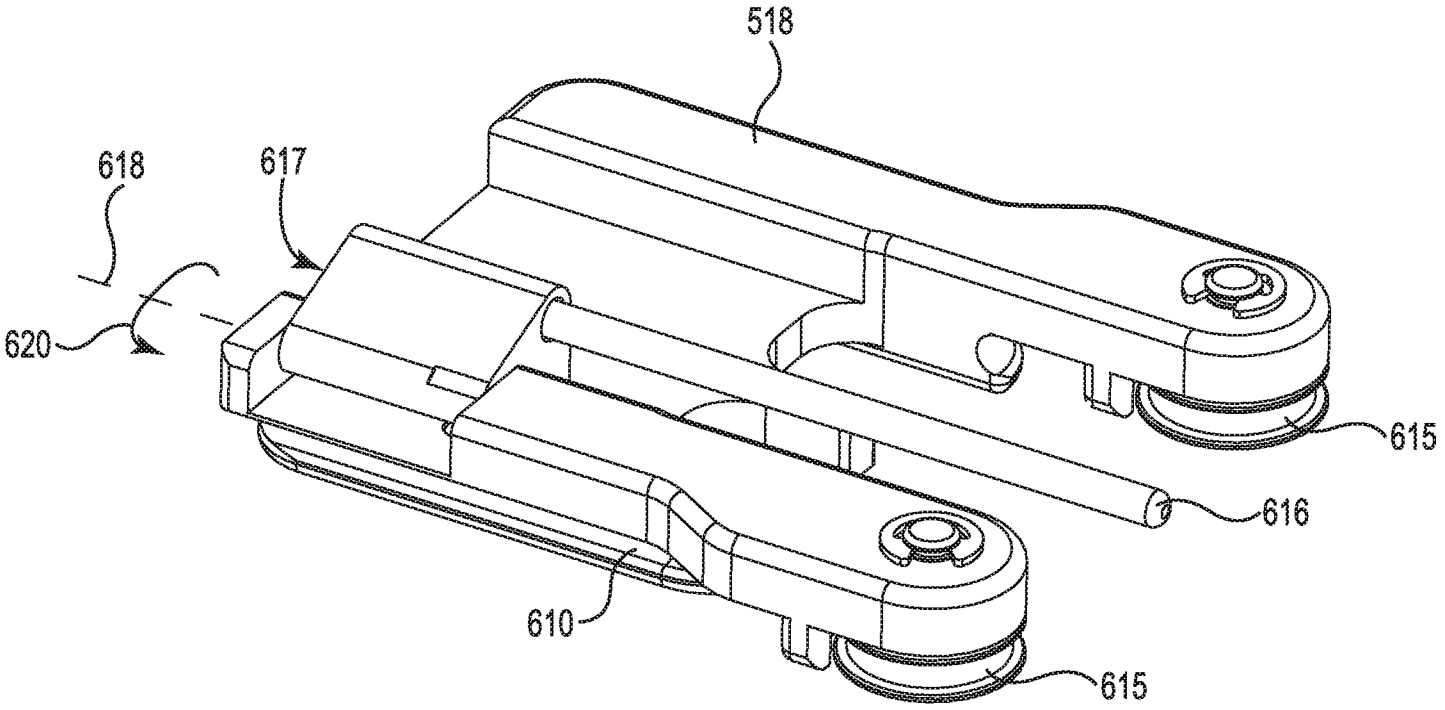
FIGS. 29A and 29B are perspective views of a traveler for a bow in accordance with an embodiment of the present disclosure.
Figure 29B:
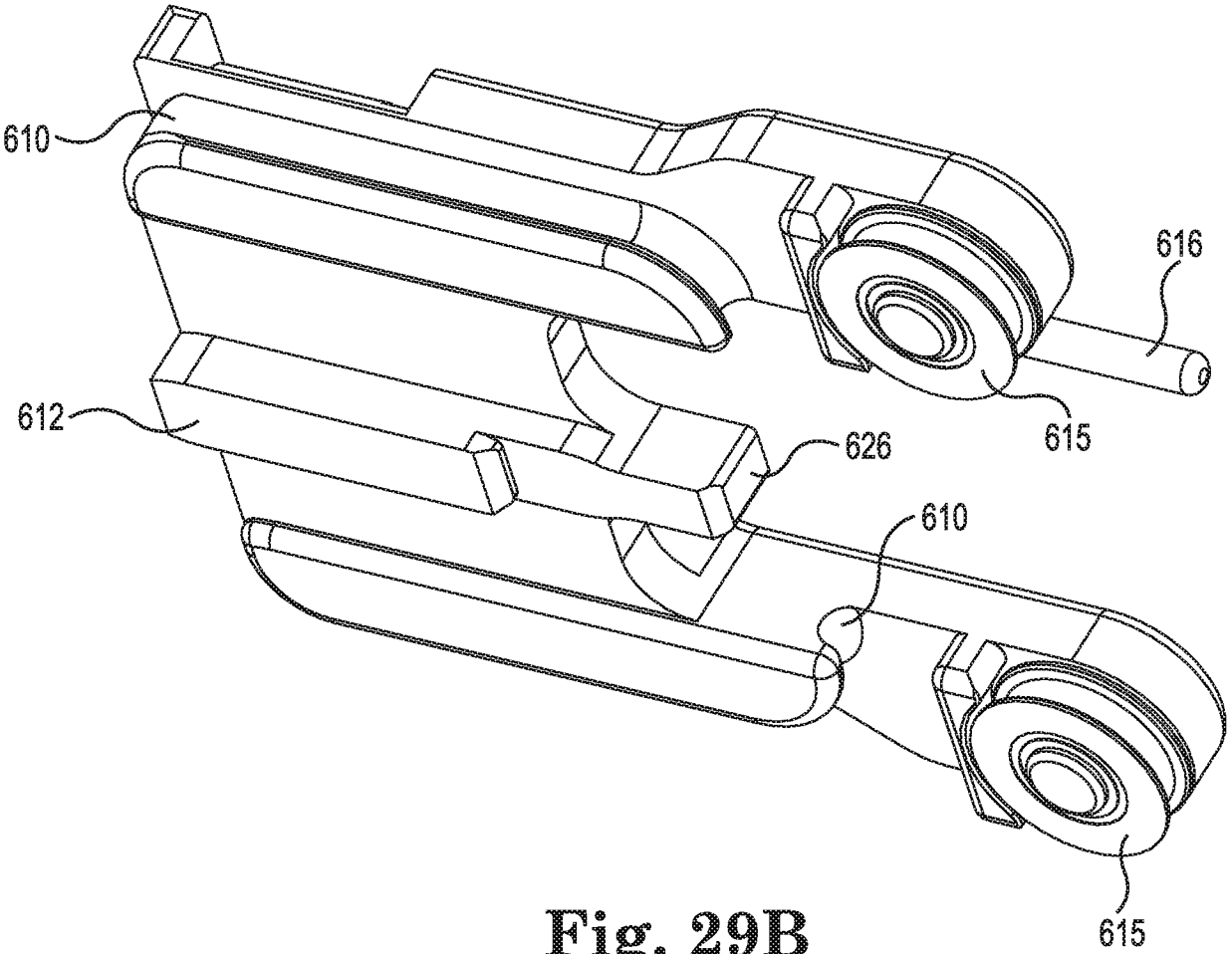

As best illustrated in FIGS. 29A and 29B, the traveler 518 includes draw string channels 610 that engage with the draw string 520, both during cocking and de-cocking of the bow 500. The cords 516 attach to pulleys 615 on the traveler 518. Guide 612 is provided on bottom of the traveler 518 that slides in the channel 614 (see FIG. 26A) in the center support 512. De-cocking actuator 616 is pivotally attached to the traveler 518 and rotates around axis 618 between active position 617 and inactive position 619 (see FIG. 30).

Figure 30:
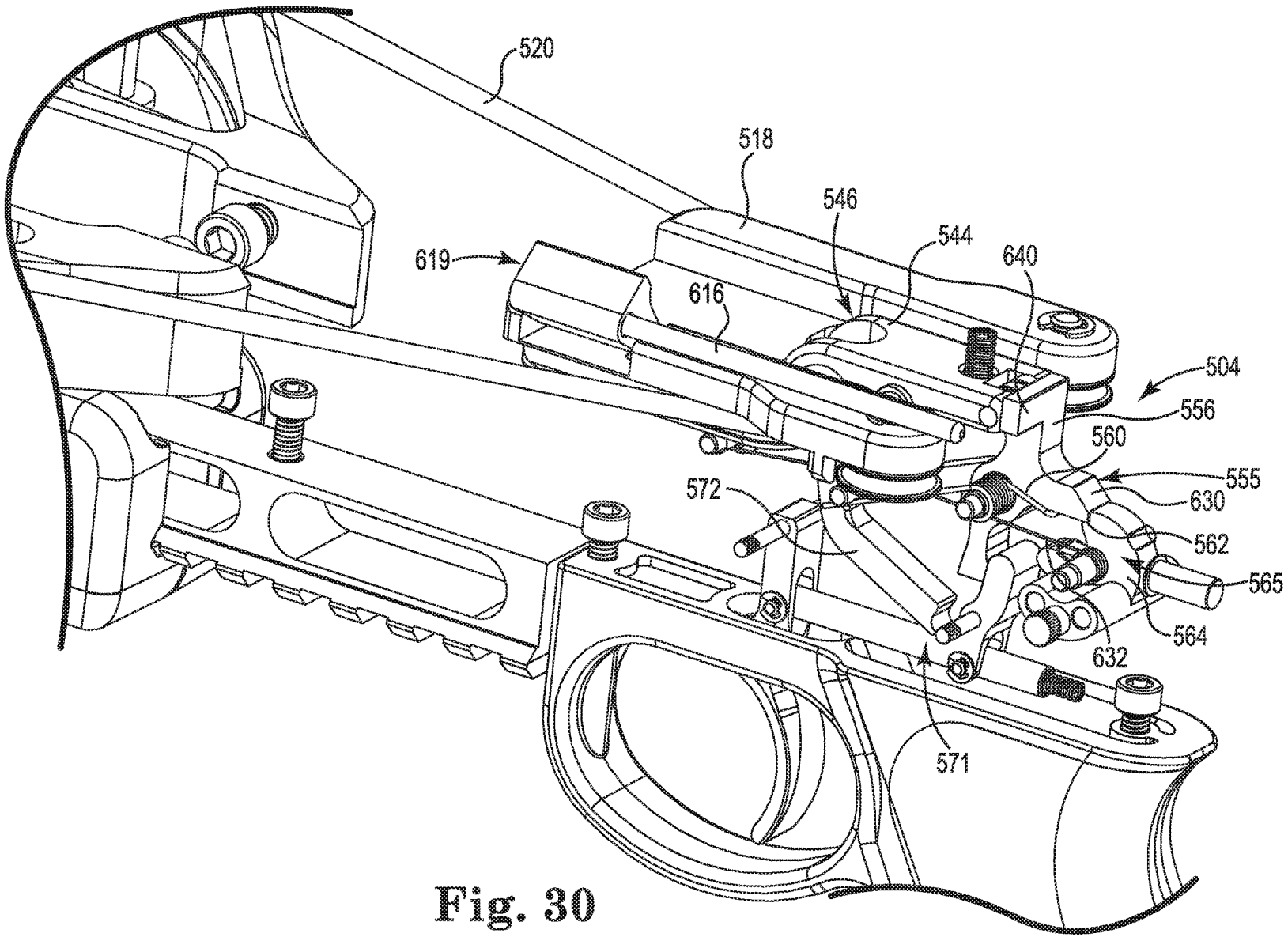
FIG. 30 is a perspective view of the trigger assembly of FIG. 27 being cocked by a cocking mechanism in accordance with an embodiment of the present disclosure.

As illustrated in FIG. 30, cocking the bow 500 requires locating the de-cocking actuator 616 in the inactive position 619 so it does not engage with the trigger assembly 504 during the cocking process. When cocking the bow 500 the trigger assembly 504 is in the open configuration 624 illustrated in FIG. 28.

As the traveler 518 advances toward the trigger assembly 504, extension 626 on the traveler 518 rotates the dry fire lockout 572 to the disengaged position 571. The draw string 520 simultaneously contacts projection 628 (see FIG. 27) on the catch 544 to move the catch 544 to the closed position 546. Spring 560 responds by rotating the sear 556 to the cocked position 555 so the catch 544 is locked in the closed position 546. In the inactive position 619 the cocking pin 616 does not engage with extension 640 on the sear 556, even when the traveler 518 is fully engaged with the trigger assembly 504.

As the sear 556 rotates to the cocked position 555, arm 630 moves the safety 564 past the detent. Spring 632 rotates the safety 564 to the safe position 565 until the shoulder 562 again locks the sear 556 in the cocked position 555. The safety 564 is preferably automatically activated whenever the bow 500 is placed in the drawn configuration 540.

Figure 28:
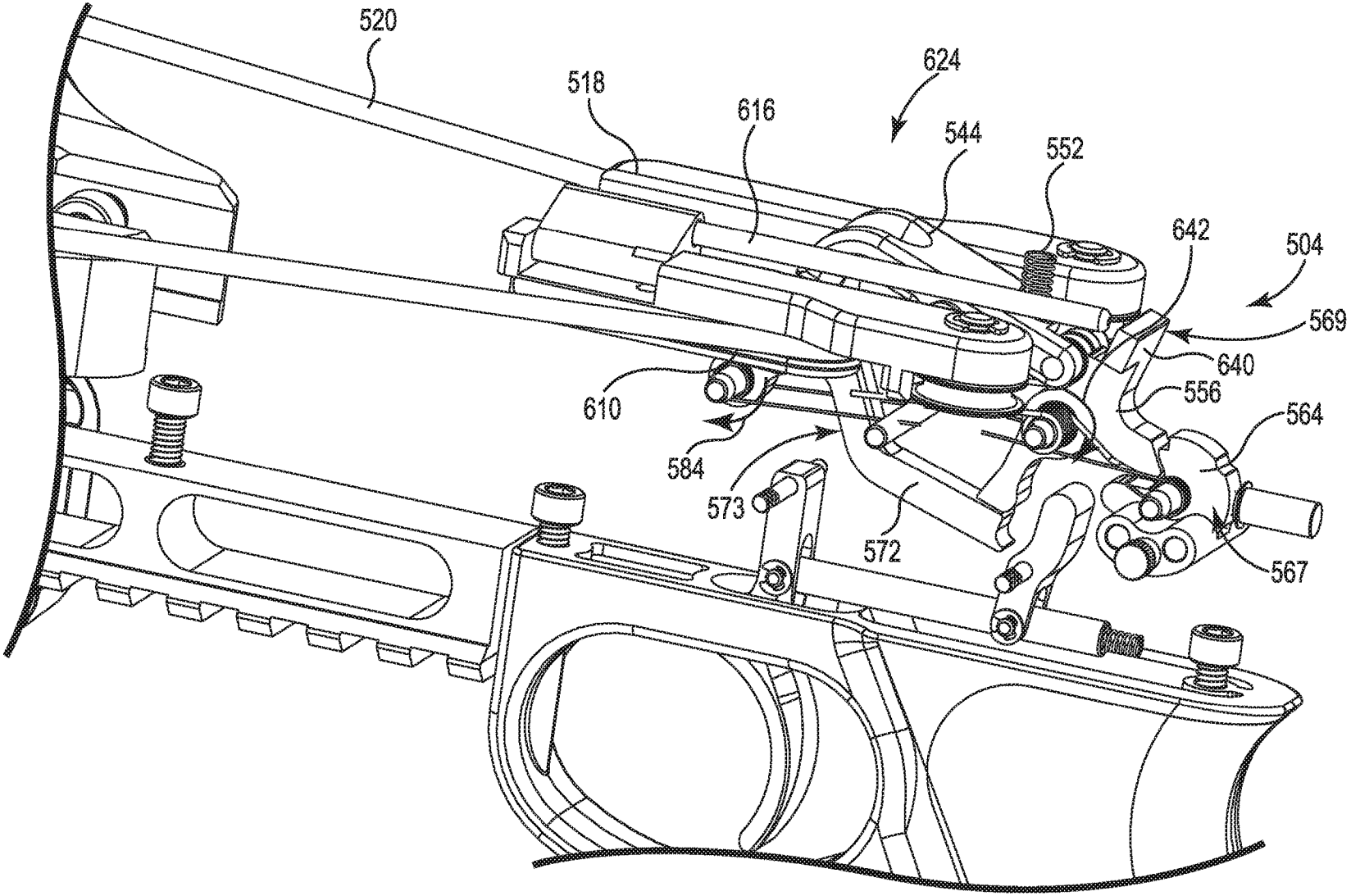
FIG. 28 is a perspective view of the trigger assembly of FIG. 27 being, de-cocked in accordance with an embodiment of the present disclosure.

De-cock the bow 500 is best illustrated in FIG. 28. The user manually disengages the safety 564. The de-cocking actuator 616 is rotated into the active position 617 illustrated in FIG. 29A. The traveler 518 is engaged with the channel 614 and the cords 516 are pulled so the extension 626 on the traveler 518 rotates with the dry fire lockout 572 in direction 584. The de-cocking actuator 616 engages the extension 640 on the sear 556 to rotate the sear 556 in direction 642 to the fire position 569. Spring 552 moves the catch 544 to the open configuration 624, releasing the draw string 520 onto the channels 610 on the traveler 518. The gap between the draw string 520 and the channels 610 on the traveler 518 is preferably very small to avoid a shock load on the cords 516 when the draw string 520 is released. The user can then slowly control movement of the draw string 520 to the release configuration 130 using the cords 516.

Where a range of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges which may independently be included in the smaller ranges is also encompassed within the disclosure, subject to any specifically excluded limit in, the stated range. Where the stated range includes one or both of the limits, ranges excluding either both of those included limits are also included in the disclosure.

Unless defined otherwise all technical and scientific terms used herein have the same meaning as commonly understood by one of ordinary skill in the art to which this disclosure belongs. Although any methods and materials similar or equivalent to those described herein can also be used in the practice or testing of the various methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments are possible. Although the description above contains much specificity, these should not be construed as limiting the scope of the disclosure, but as merely providing illustrations of some of the presently preferred embodiments. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form varying modes disclosed. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present, claims. Furthermore, no element, component, or method step in the present disclosure is intended to be dedicated to the public regardless of whether the element, component, or method step is explicitly recited in the claims.

What is claimed is:

1. A crossbow comprising:

a frame comprising a center rail extending generally along a longitudinal axis of the frame;

a first translation arm mount disposed at a first side of the frame and at a distal end of the frame;

a second translation arm mount disposed at a second side of the frame and at the distal end of the frame;

a first limb assembly disposed at a first distal end of the first translation arm mount, the first limb assembly comprising:

a first upper limb and a first lower limb;

a second limb assembly disposed a second distal end of the second translation arm mount, the second limb assembly comprising:

a second upper limb and a second lower limb;

a first pulley disposed between the first upper limb and the first lower limb;

a second pulley disposed between the second upper limb and the second lower limb;

a draw string coupled to each of the first pulley and the second pulley;

one or more cords indirectly coupled to the draw string through one or more pulleys, the one or more cords operable to release the draw string;

a trigger assembly comprising:

a trigger operable to fire the crossbow;

a safety operable to selectively disengage the trigger assembly;

a catch moveable between a closed position that holds the draw string in a drawn configuration and an open position that releases the draw string to a released configuration; and a sear moveable between a cocked position that retains the catch in the closed position and a fire position that permits the catch to move to the open position to release the draw string;

a dry fire lockout mechanism that, when engaged, prevents release of the draw string if a bolt is not positioned on the center rail; and a de-cocking actuator that is selectively positioned between an inactive position in which the de-cocking actuator does not engage with the trigger assembly, and an active position, the de-cocking actuator comprising at least a portion that, while in the active position, engages an extension of the sear and rotates the sear in a direction to the fire position to thereby release the draw string independently from activation of the trigger, wherein the de-cocking actuator releases the draw string from the trigger assembly responsive to a user activating the de-cocking actuator into the active position and pulling the one or more cords to thereby disengage the dry fire lockout mechanism.

2. The crossbow of claim 1, wherein each of the first pulley and the second pulley is substantially circular.

3. The crossbow of claim 2, wherein the first upper limb and the first lower limb are rigidly coupled to the first translation arm mount, and wherein the second upper limb and the second lower limb are rigidly coupled to the second translation arm mount.

4. The crossbow of claim 1, wherein a proximal portion of each of the first limb assembly and the second limb assembly is not attached to the frame.

5. The crossbow of claim 1, further comprising:

a first power cable having a first end and an opposing second end, wherein the first end of the first power cable is coupled to the first pulley at least one power cable anchor of the first pulley; and a second power cable having a first end and an opposing second end, wherein the first end of the second power cable is coupled to the second pulley at least one power cable anchor of the second pulley.

6. The crossbow of claim 1, wherein the crossbow is configured to be coupled to a rotary crank cocking mechanism.

7. The crossbow of claim 1, further comprising:

at least one stirrup attached to the distal end of the frame; and one or more handles attached to respective ends of the one or more cords.

* * * * *